US010895104B1

(12) United States Patent
Hertel

(10) Patent No.: US 10,895,104 B1
(45) Date of Patent: Jan. 19, 2021

(54) DEVICE FOR FORMING A TEMPORARY SEAL FOR FLOOD PROTECTION

(71) Applicant: Diana L. Hertel, Houston, TX (US)

(72) Inventor: Diana L. Hertel, Houston, TX (US)

(73) Assignee: Diana L. Hertel, Houston, TX (US)

( * ) Notice: Subject to any disclaimer, the term of this patent is extended or adjusted under 35 U.S.C. 154(b) by 0 days.

(21) Appl. No.: 16/787,660

(22) Filed: Feb. 11, 2020

(51) Int. Cl.
*E06B 7/00* (2006.01)
*E06B 7/23* (2006.01)
*E06B 9/00* (2006.01)

(52) U.S. Cl.
CPC ..... *E06B 7/23* (2013.01); *E06B 9/00* (2013.01); *E06B 2009/007* (2013.01)

(58) Field of Classification Search
CPC . E04B 7/16; B29C 65/70; B29C 65/76; E06B 1/62; E06B 7/23
See application file for complete search history.

(56) References Cited

U.S. PATENT DOCUMENTS 2,145,284 A 1/1939 Anderson et al.
2,835,612 A 2/1943 Coutlee
2,454,821 A 11/1948 McKee
3,167,440 A 1/1965 McVicker
3,401,486 A 9/1968 Adell
4,178,717 A * 12/1979 Sakauye ..... E06B 7/16 16/82
4,449,267 A 5/1984 Siemion
4,488,386 A 12/1984 Thompson
4,611,429 A * 9/1986 Kanies ..... E06B 7/16 15/257.01
4,629,648 A 12/1986 Minick et al.
4,650,368 A 3/1987 Bayer
4,660,323 A * 4/1987 Kanies ..... E06B 7/23 15/257.01
5,157,063 A 10/1992 Wetherell
5,498,645 A 3/1996 Mariano et al.
5,730,446 A 3/1998 Taylor et al.
(Continued)

FOREIGN PATENT DOCUMENTS

DE 20208217 U1 10/2002
DE 102006018557 A1 10/2007
(Continued)

OTHER PUBLICATIONS

Claytoon Instructions, addendum to IDS NPL citation 14, dated Mar. 2014.*
(Continued)

*Primary Examiner* — Beth A Stephan
(74) *Attorney, Agent, or Firm* — Park, Vaughan, Fleming & Dowler LLP

(57) ABSTRACT

One illustrative kit disclosed herein includes a package and a plurality of individual sections of a moldable material positioned within the package, wherein each of the individual sections of the moldable material have an axial length. In this example, when viewed in a cross-section taken through the individual sections of moldable material in a direction transverse to the axial length, each of the individual sections of the moldable material have a non-rectangular cross-sectional configuration for at least a portion of the axial length of each of the individual sections of the moldable material.

25 Claims, 18 Drawing Sheets

(56) References Cited

U.S. PATENT DOCUMENTS

| | | | |
|---|---|---|---|
| 6,425,213 | B1 | 7/2002 | Lachapelle |
| 6,460,299 | B1 | 10/2002 | Burrow |
| D574,088 | S | 7/2008 | Kercher, III |
| 7,762,742 | B1 | 7/2010 | Smith |
| 8,287,209 | B2 | 10/2012 | Feldman et al. |
| 8,287,982 | B2 | 10/2012 | Brewin et al. |
| 8,633,269 | B2 | 1/2014 | Cordova |
| 8,986,438 | B2 | 3/2015 | Merrifield et al. |
| 9,273,196 | B2 | 3/2016 | Doane, Jr. et al. |
| 2003/0110717 | A1 | 6/2003 | Rodriguez |
| 2011/0283627 | A1 | 11/2011 | Shaw |
| 2013/0108372 | A1 | 5/2013 | Abeles |
| 2014/0193203 | A1 | 7/2014 | Richardson |
| 2017/0174963 | A1 | 6/2017 | Riepl et al. |

FOREIGN PATENT DOCUMENTS

| | | | |
|---|---|---|---|
| DE | 20011000107 | U1 | 6/2012 |
| GB | 2509732 | A | 7/2014 |
| JP | 3157170 | A | 7/1991 |
| JP | 2001108110 | A | 4/2001 |
| WO | 2012098115 | A1 | 7/2012 |

OTHER PUBLICATIONS

Bright Colors Modeling Craft, pictures of materials, available at least as early as Dec. 2018.*
Bright Colors Modeling Craft, reviews, available at least as early as Dec. 201.*
Prime Line Plumbers putty, for sale on Amazon, available at least as early as Oct. 2015.*
Prime Line Plumbers putty, reviews, available at least as early as Oct. 201.*
Toblerone, for sale on Amazon, available at least as early as Jul. 2015.*
Modeling Sticks Reusable and Non drying triangular; available at least as early as Mar. 28, 2019.*
Extra sodt, endlessly resuable kids modeling clay; available at least as early as Apr. 2, 2019.*
Plastilina modeling clay; available at least as early as Jul. 25, 2019.*
Plastilina modeling clay roll; available at least as early as Jul. 23, 2019.*
Moldable Silicone Putty; available at least as early as May 14, 2019.*
3M Fire Water Barrier Tape Brochure (Year: 2017).
3M Fire and Water Barrier Tape: Installation Guide (Year: 2017).
3M Moldable Putty Installation Guide (Year: 2015).
"Taking the Mystery Out of How to Make a Concrete Sink Mold" (found at www.reynoldsam.com/smogal/?id=196; publication date of Sep. 2008; hereinafter referred to as N PL); 6 pages.
International Search Report and Written Opinion from PCT/US2018/066687 dated Jun. 3, 2019.
3M Fire Barrier Sealant, Amazon.com, https://www.amazon.com/3M-Fire-Barrier-Sealant-Sausage/dp/BOOMJ9FQAY, 5 pages. (Year: 2014).
3M Fire Barrier Moldable Putty Stix, Amazon.com, https://www.amazon.com/Fire-Barrier-Moldable-Putty-Stix/dp/B072PXMSN9, 8 pages. (Year 2016).
3M Fire Barrier Moldable Putty Pads, Amazon.com, https://www.amazon.com/Fire-Barrier-Moldable-Putty-Pads/dp/B0719TKS8C, 5 pages. (Year: 2014).
Sargent Art Plastilina Modeling Clay, Amazon.com, https://www.amazon.com/Sargent-Art-Plastilina-Modeling-5-Pound/dp/BOOFR7TR10, 9 pages. (Year: 2016).
HoneyToys Modeling Clay, Amazon.com, https://www.amazon.com/HoneyToys-Colorful-Modeling-Color%EF%BC%SCNo-Toxic-Creative/dp/801 MZ38CQB, 8 pages. (Year 2017).
Van Aken International—Claytoon—Modeling Clay, Amazon.com, https://www.amazon.com/Van-Aken-International-Non-Hardening-Gluten-Free/dp/8001 UNJN50, 9 pages. (Year: 2014).
Sago Brothers Modeling Clay, Amazon.com, https://www.amazon.com/Sago-Brothers-Modeling-Molding-Colors/dp/BOORF7A1 TG, 11 pages. (Year: 2015).
Van Aken Plastalina Modeling Clay, Texas Art Supply, https://web.archive.org/web/20130325192048/http://www.exasart.com/crafts/polymer-and-hobby-clay/hobby-clay/van-aken-plastalina-modeling-clay.html, 3 pages. (Year: 2013).
Sugru Moldable Glue, Amazon.com, https://www.amazon.com/Sugru-Moldable-Glue-Original-Formula/dp/B008URBC91, 12, pages. (Year 2017).
Allman, 'What's the Best Polymer Clay Brand?', The Blue Bottle Tree, https://thebluebottletree.com/best-polymer-clay-brand/, 11 pages (Year 2015).
'Clay Storage', Polymer Clay Web, http://www.polymerclayweb.com/AboutPolymerClay/TheBasics/ClayStorage.aspx, 2 pages. (Year: 2013).

* cited by examiner

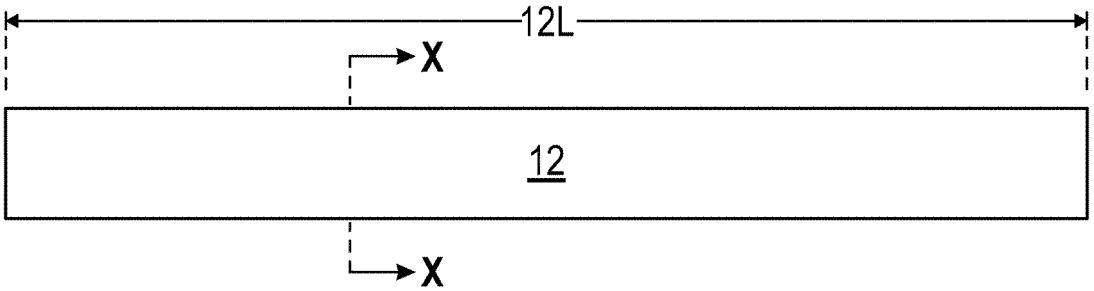
FIG. 21
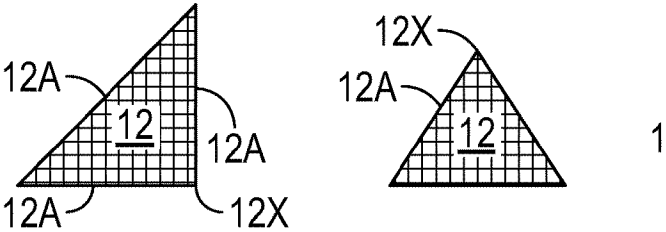
FIG. 22
FIG. 23
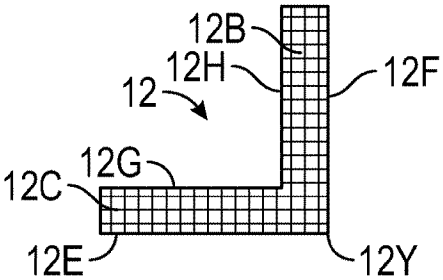
FIG. 24
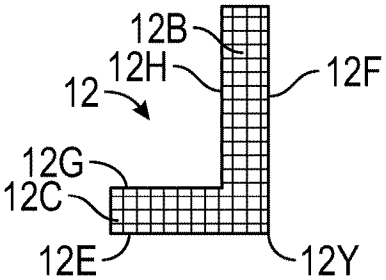
FIG. 25
FIG. 26 (View X-X)
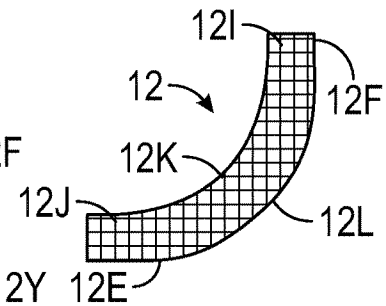
FIG. 27 (View X-X)
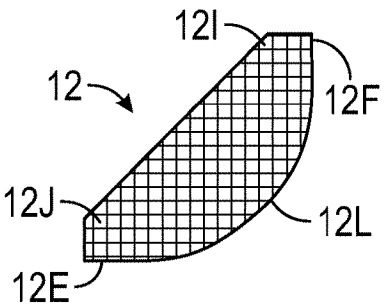
FIG. 28 (View X-X)
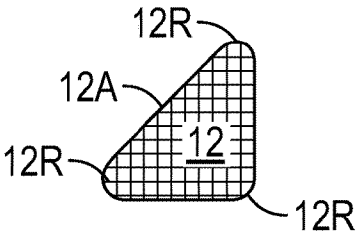
FIG. 29

Door Hanger-Side A
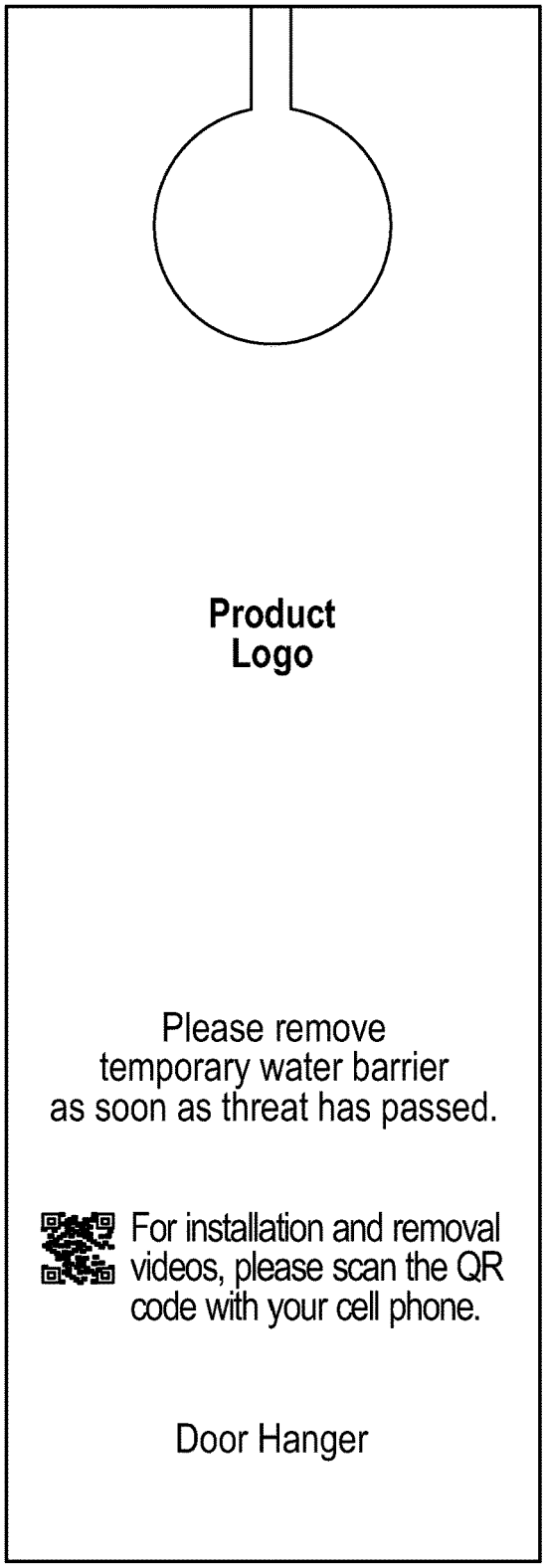
Door Hanger-Side B
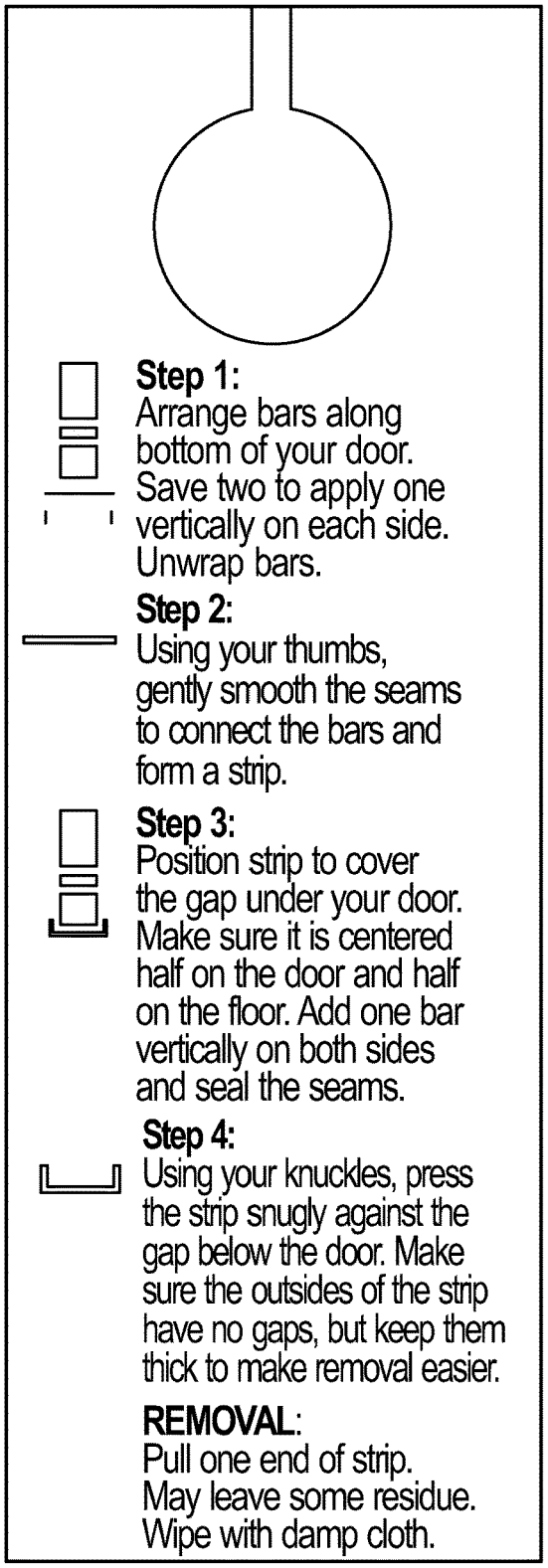
Sample language. Subject to change
70
FIG. 41

DEVICE FOR FORMING A TEMPORARY SEAL FOR FLOOD PROTECTION

BACKGROUND OF THE INVENTION

1. Field of the Invention

The present disclosure generally relates to the field of temporary flood protection devices and, more specifically, to methods, devices and kits for forming a temporary seal to prevent water from entering a home or a building.

2. Description of the Related Art

Municipalities and federal and state governments go to great lengths and spend enormous sums of money in an effort to protect residences and commercial properties from flooding. For example, infrastructures such as dams, underground water drainage systems and drainage canals are formed in an effort to control the flow of rainwater and rivers, and to try to keep water in lakes or reservoirs from overflowing. However, in some cases, despite the best efforts of all involved, systems may fail, or weather conditions may be so bad as to simply overwhelm the infrastructure in place for water control. As a result, flooding of residences and/or businesses may occur. Flooding can cause a great deal of monetary damage and emotional anguish to those that are adversely impacted. Even a few inches of flood water in a residence can cause extensive damage, disrupt families' lives for months and take months to repair. Similar problems can arise in the context of business operations as well and can result in loss of significant revenues.

Thus, in some situations, residents and business owners have undertaken measures to try to form some sort of temporary means of preventing flood damage to their properties when there is danger that flooding may occur. One common technique involves placing sandbags around the area to be protected. While this technique can be effective in certain situations, it is very labor-intensive, very time-consuming and typically must be done several days in advance of the anticipated flooding event, because at or near the time of an actual flooding event, it may be difficult to obtain the necessary manpower and supplies to produce the required number of sandbags.

What is needed is a relatively inexpensive, effective and non-labor-intensive means of providing a temporary seal that may be used by homeowners and business owners to prevent or at least reduce the chances of water entering a residence or place of business during a flooding event.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the present disclosure is directed to various novel embodiments of methods, devices and kits for forming a temporary seal to prevent water from entering a structure, such as a home or a building. One illustrative method disclosed herein includes positioning a plurality of individual sections of a moldable material adjacent one another and adjacent a structure to be sealed, and forcing the individual sections against one another and at least the structure so as to deform the plurality of individual sections and thereby form a substantially contiguous temporary seal comprised of the moldable material between the structure and at least a portion of the opening in which the structure is positioned.

One illustrative device disclosed herein includes an individual section of a moldable material that has an axial length, wherein, when viewed in a cross-section taken through the individual section of moldable material in a direction transverse to the axial length, the individual section of the moldable material has a non-rectangular cross-sectional configuration for at least a portion of the axial length of the individual section of the moldable material. In one particular example, the individual section of the moldable material has the non-rectangular cross-sectional configuration for substantially the entire axial length of the individual section of the moldable material.

One illustrative kit disclosed herein includes a package and a plurality of individual sections of a moldable material positioned within the package, wherein each of the individual sections of the moldable material have an axial length. In this example, when viewed in a cross-section taken through the individual sections of moldable material in a direction transverse to the axial length, each of the individual sections of the moldable material have a non-rectangular cross-sectional configuration for at least a portion of the axial length of each of the individual sections of the moldable material.

One illustrative device disclosed herein includes a substantially contiguous seal comprised of a plurality of individual sections of moldable material that are adapted to be positioned against a surface of a structure and a surface of an opening in which the structure is adapted to be positioned, at least some of the moldable material adapted to be positioned between at least a portion of the structure and at least a portion of the opening.

One illustrative kit disclosed herein includes a package and a plurality of individual sections of moldable material positioned within the package, each of the plurality of individual sections of moldable material being separated from one another by at least one layer of material. In this example, the kit also includes instructions for forming a substantially contiguous seal between a structure and an opening in which the structure is positioned by deforming the plurality of individual sections of the moldable material, wherein the instructions are included in or are part of the package.

Yet another illustrative device disclosed herein includes a package and a plurality of individual sections of a moldable material positioned within the package, wherein the plurality of individual sections of the moldable material are adapted to be deformed into a substantially contiguous seal between a first structure and a second structure and wherein the number of the individual sections of the moldable material within the package is selected so as to provide the necessary quantity of the plurality of individual sections of the moldable material so as to form the substantially contiguous seal.

BRIEF DESCRIPTION OF THE DRAWINGS

The disclosure may be understood by reference to the following description taken in conjunction with the accompanying drawings, in which like reference numerals identify like elements, and in which:

FIGS. 1-41 are various views that depict various novel embodiments of methods, devices and kits for forming a temporary seal to prevent water from entering a structure, such as a home or a building.

Figure 1:
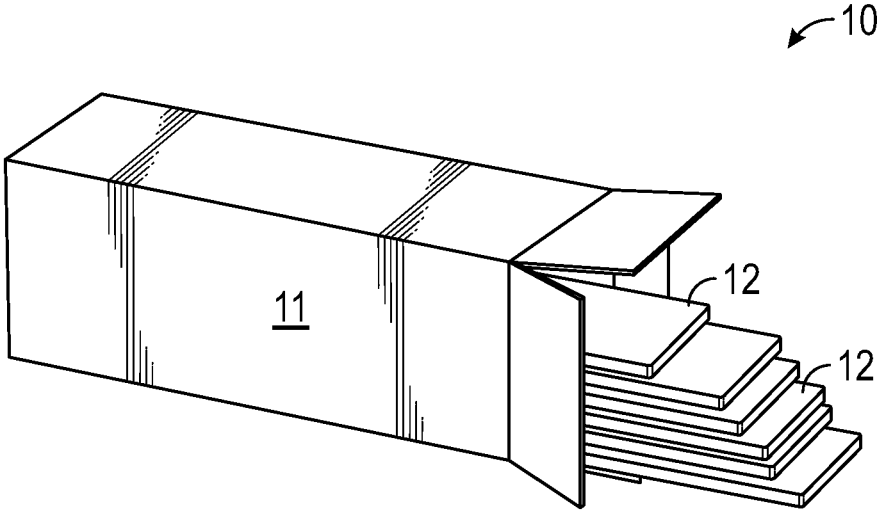

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art after having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIGS. 1-41 are various views that depict various novel embodiments of methods, devices and kits for forming a temporary seal from a moldable material to prevent water from entering a structure, such as a home or a building. In one illustrative embodiment, the methods disclosed herein involve forming a substantially contiguous temporary seal from a moldable material. The presently disclosed inventions will be discussed in the context where such a substantially contiguous temporary seal is formed adjacent a door of a home.

However, as will be appreciated by those skilled in the art after a complete reading of the present application, the substantially contiguous temporary seal disclosed herein may be employed in applications other than those specifically depicted. Thus, the presently disclosed inventions should not be considered to be limited to the illustrative applications disclosed herein.

Figure 2:
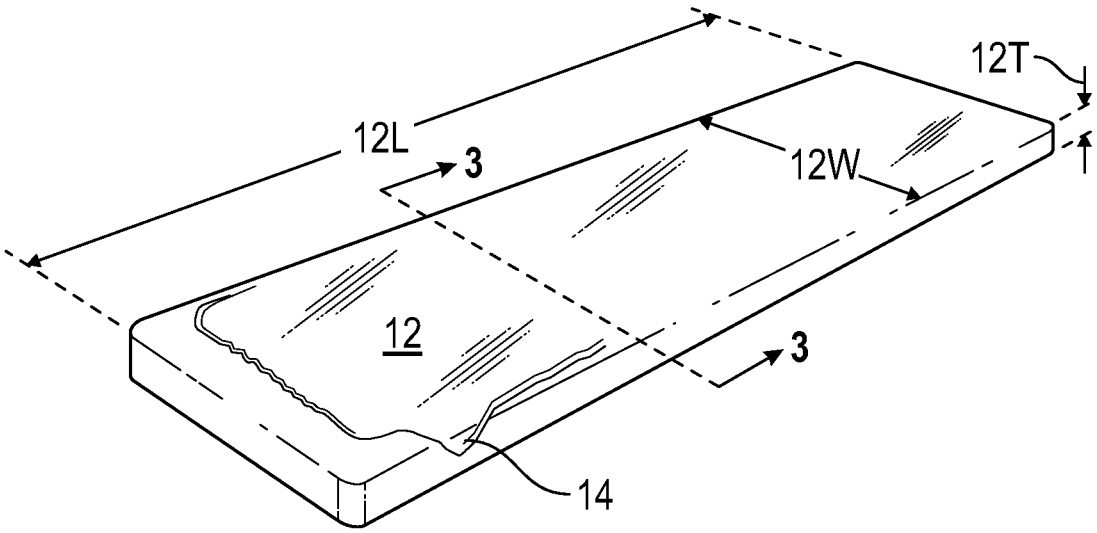
Figure 3:
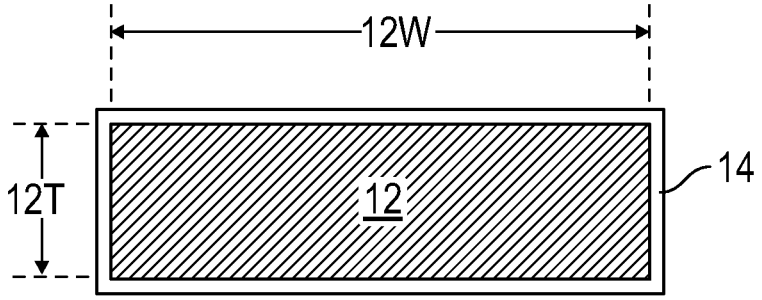
Figure 4:
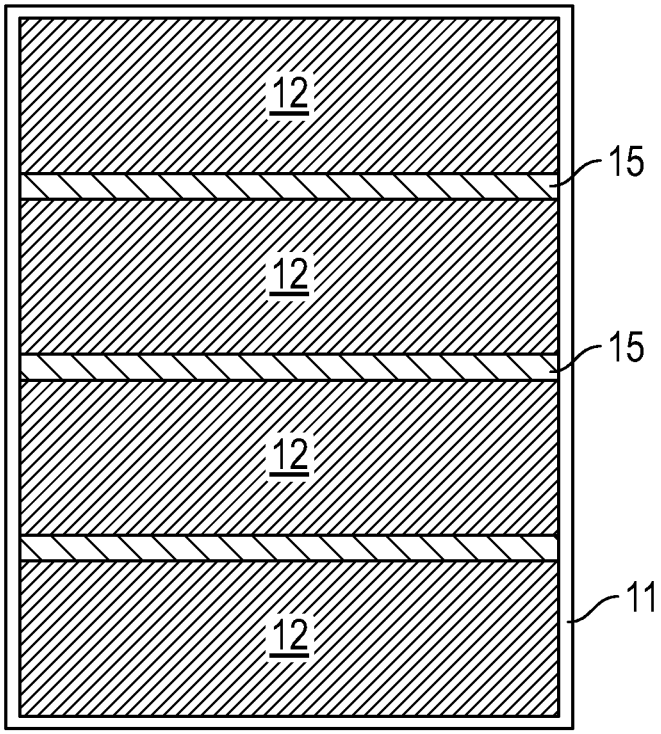

FIG. 1 is a perspective view of one illustrative embodiment of a kit 10 that includes a package 11 that contains a plurality of individual sections 12 of a hand-moldable material. FIG. 2 is an enlarged perspective view of one illustrative embodiment of one of the individual sections 12 of moldable material. FIG. 3 is a cross-sectional view of the illustrative individual section 12 of moldable material shown in FIG. 2. In one illustrative embodiment, the package 11 may take the form of a box, such as a cardboard box. In other cases, the package 11 may take the form of a shrink-wrapped material (not shown) that encapsulates all of the plurality of individual sections 12. As indicated in FIG. 2, in one illustrative embodiment, each of the individual sections 12 of moldable material are individually wrapped in a plastic (or similar material) wrapping 14 to keep the individual sections 12 of moldable material separate from one another. FIG. 4 depicts a cross-sectional view of another embodiment wherein each of the plurality of individual sections 12 is separated from one another by a plastic sheet 15.

The overall size and configuration of the individual sections 12 of moldable material may vary depending upon the particular application and as a matter of design choice. In one illustrative example, the individual sections 12 of moldable material take the form of a substantially rectangular shaped block of material having a length 12L, a width 12W and a thickness 12T, the dimensions of which may vary depending upon the particular application. In one illustrative example, the length 12L may be about 10 inches, the width 12W may be about 3 inches, and the thickness 12T may be about 0.5 inches. In one illustrative embodiment, the individual sections 12 of moldable material may be made of a hand-moldable material such as, for example, modeling compound, which in some cases may be known as plastilina/plastalina clay. In one particular embodiment, the moldable material may comprise an oil-based or wax-based material so as to enhance the ability of the moldable material to form a seal against water intrusion into a building or home. This type of material typically remains pliable and it is typically designed not to harden.

The size and number of individual sections 12 of moldable material provided in the kit 10 may vary depending upon the particular application. In one illustrative example, the kit 10 may contain a sufficient number of individual sections 12 of moldable material so as to permit formation of a substantially contiguous temporary seal 30 disclosed herein on a standard single door, having a width of about 36 inches. In such an application, if a consumer needs to form a temporary seal on a set of double doors, the consumer will simply purchase two of the kits 10. In other cases, the kit 10 may contain a sufficient number of individual sections 12 of moldable material so as to permit the formation of the substantially contiguous temporary seal 30 disclosed herein on a set of French doors (of a specified width) or on a garage door (of a specified width). The kit 10 also comprises instructions (not shown) in the form or text and/or drawings on how to form the substantially contiguous temporary seal 30 disclosed herein. In one example, the instructions may be printed on the outside of the package 11 or the instructions may be written on one or more sheets of paper that are included within the package 11. Such instructions may also include text and/or pictures that instruct a consumer as to how to form the individual sections 12 of moldable material to plug or block other potential paths of water ingress into a home or building, such as weep holes, as described more fully below.

One illustrative method for forming the novel substantially contiguous temporary seal 30 disclosed herein will now be discussed. In general, in one illustrative embodiment, the methods disclosed herein involve forming a substantially contiguous, substantially water-tight seal 30 comprised of the moldable material between a structure that is to be sealed (such as a door, a window or a garage door) and at least a portion of the opening (e.g., a door frame, a floor, a window sill, etc.) in which the structure is positioned. In one particular example, this is accomplished by forcing a plurality of the individual sections 12 of moldable material against one another and at least the structure that is to be sealed so as to deform the plurality of individual sections 12 of moldable material and thereby form the substantially contiguous seal 30 comprised of the moldable material between the structure to be sealed and at least a portion of the opening (in which the structure is positioned). The moldable material has a composition and consistency so as to permit an individual to mold, deform and force the moldable material by hand so as to form the desired seal 30. As used herein and in the claims, the term "moldable material" shall be understood to be a material that is capable of being deformed by application of a force supplied by an adult human being of average strength. Typically, a user may physically deform the sections 12 of moldable material to achieve the seal 30 by applying force with the user's fingers and thumbs, i.e., deforming the moldable material via direct contact with human hands. In other cases, a human may use a relatively blunt object or "tool," such as the handle of an ordinary hammer, the end of a broom, a wooden spoon, etc., during some or all of the process of deforming the sections 12 of moldable material to achieve the desired seal 30.

Figure 5:
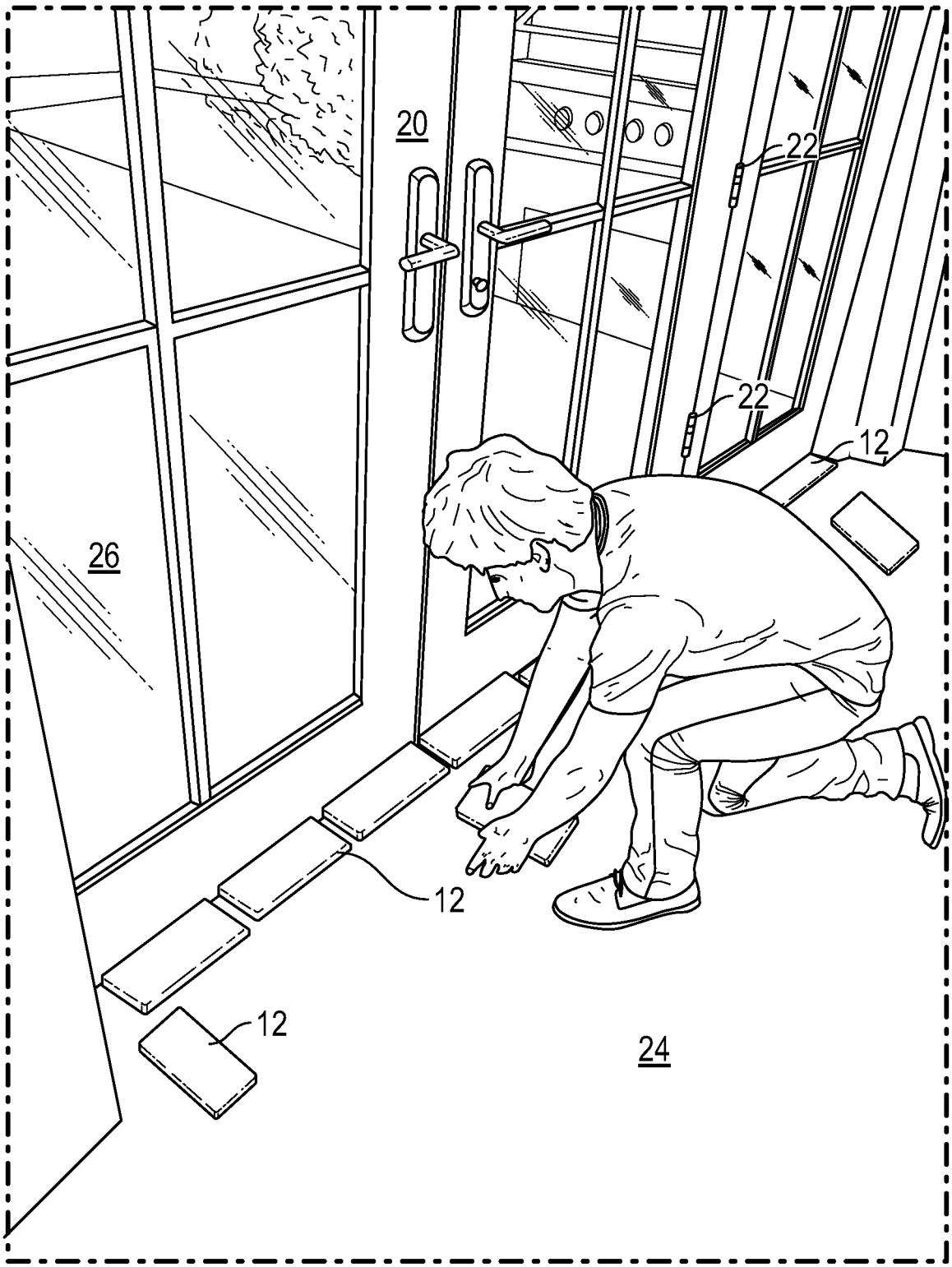

FIG. 5 depicts an embodiment wherein the novel seal 30 disclosed herein will be formed adjacent a structure or door 20, in this case a set of double doors. At the point shown in FIG. 5, the individual sections 12 of moldable material have been removed from the package 11 and placed in approximate locations adjacent the door 20 on the interior side of the door 20. In the example disclosed herein, the seal 30 will be formed on the interior surface of the door 20. However, as will be appreciated by those skilled in the art after a complete reading of the present application, the novel seal 30 disclosed herein may also be formed on the exterior surface of the door 20 or on both the interior and exterior surfaces of the door 20. With reference to FIG. 5, the door 20 is mounted to a door frame or jamb with a plurality of hinges 22. The interior floor 24 and exterior floor 26 of the building are also depicted in FIG. 5. The novel seal 30 disclosed herein may be employed irrespective of the type of flooring used for the interior and exterior floors 24, 26, e.g., bricks, blocks, wood, tile, etc., and irrespective of the surface finish of the interior and exterior floors 24, 26. That is, one feature of the novel seal 30 disclosed herein is that, due to the moldable nature of the molding material of the sections 12, the material may be deformed to accommodate virtually any type of surface (be it smooth, or rough or irregular) on either the floor, the doorjamb, or the door itself so as to form the desired seal 30.

Figure 6:
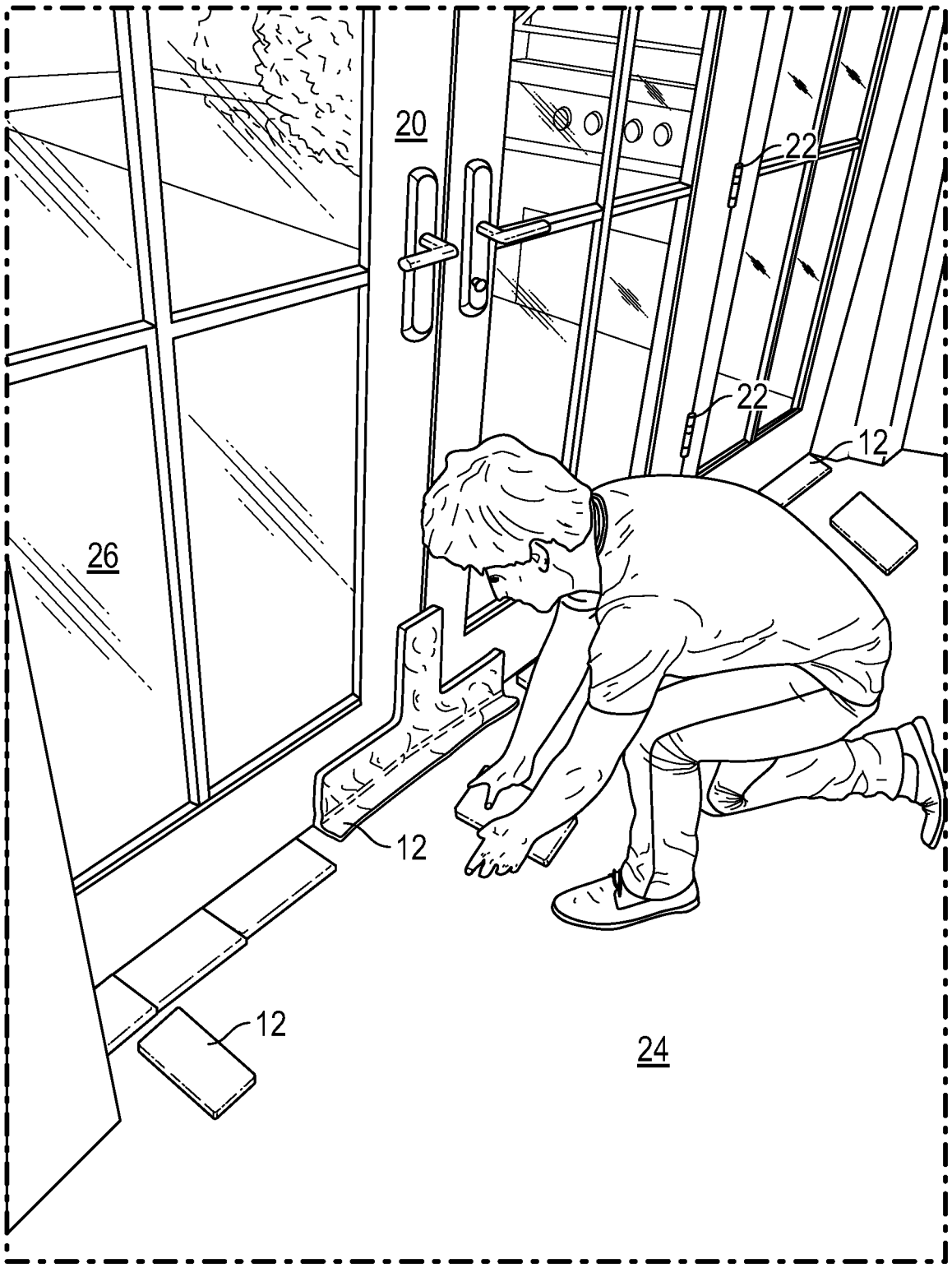

At the point of operations shown in FIG. 6, the individual sections 12 of moldable material have been positioned laterally adjacent one another in preparation of beginning the actual process of forming the seal 30 and some of the individual sections have been deformed by the individual as part of the process of forming the seal 30. Prior to this point, if needed, one or more sections of the individual sections 12 of moldable material may be cut to a shorter desired length to, for example, fill in a gap between the end of a section and the door jamb, wherein the gap is less than the full length of a single section 12. The moldable material used herein may be readily cut with a common case knife, a putty knife, or it may even be torn into smaller sections by hand.

Figure 7:
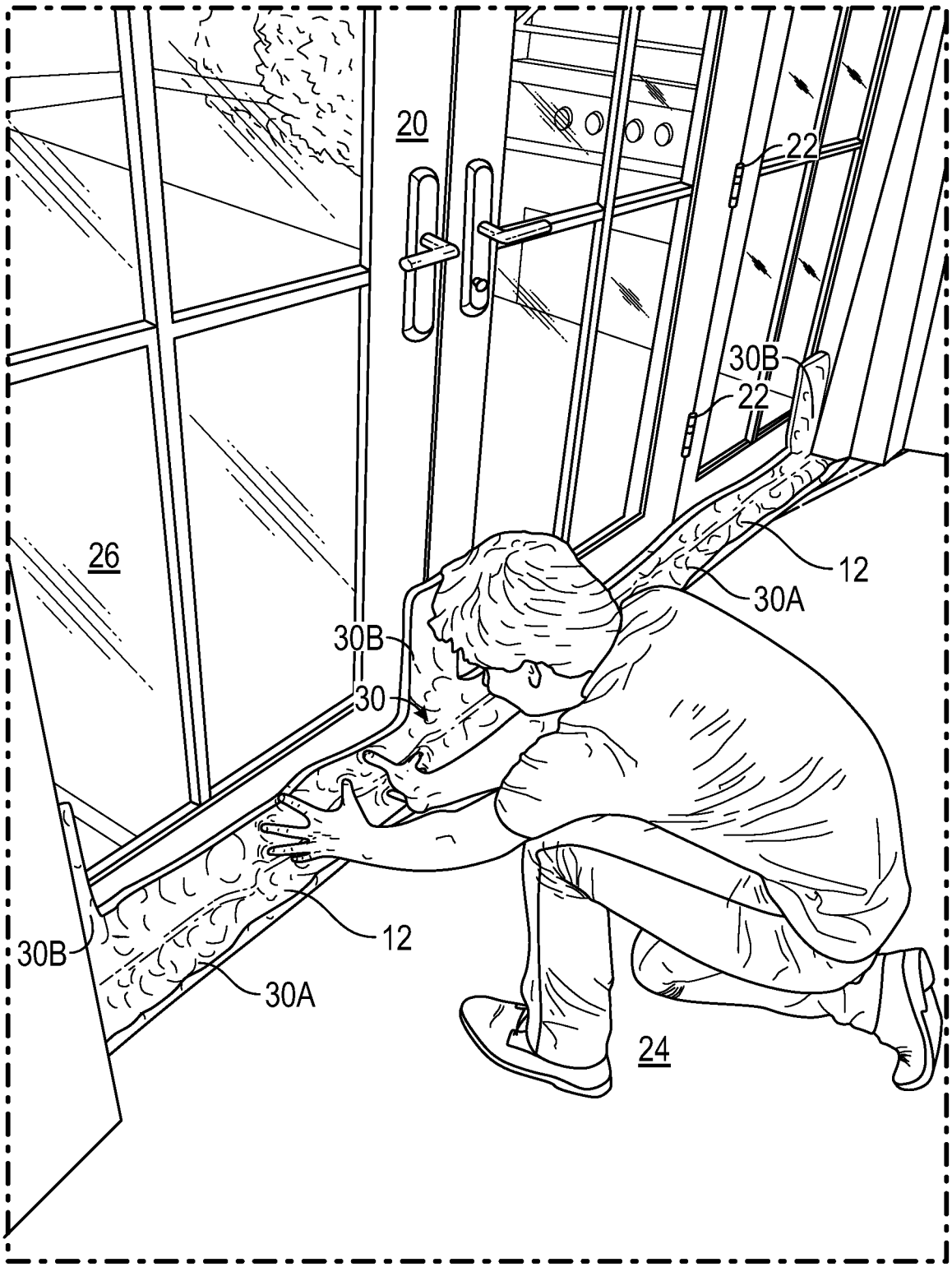

FIG. 7 depicts one illustrative embodiment of the novel seal 30 disclosed herein after the seal 30 has been installed. In this particular example, the novel seal 30 has a substantially horizontally oriented portion 30A and a plurality of substantially vertically oriented portions 30B. As shown in FIG. 7, the novel seal 30 comprises a plurality of substantially U-shaped sections in which one of the substantially vertically oriented portions 30B is effectively shared by adjacent U-shaped sections of the seal 30. To form the seal 30, in one illustrative example, a person applies force by hand to force the individual sections 12 of moldable material against one another and against the door 20 and the surrounding opening (e.g., the floor 24, the threshold (not shown) under the door 20, the door jamb and the lowermost hinges 22) so as to thereby form the substantially contiguous, substantially water-tight seal 30 comprised of the moldable material between the door 20 and at least a portion of the opening in which the door 20 is positioned. This may be accomplished by starting in the middle of the door 20 (as shown in FIG. 6) and working outward from the center of the door 20 toward one side of the door jamb, followed by doing the same process on the other side of the door 20. In other cases, the person may simply start from one end of the area to be sealed and proceed to form the seal 30 by progressing across the door 20, e.g., from left to right. During this process, the moldable material is forced into spaces between the door 20 and its opening, e.g., into spaces between the door 20 and the interior floor 24, the spaces between the door 20 and the door jamb, and the spaces between the bottom of the door and the door threshold (not shown).

Figure 10:
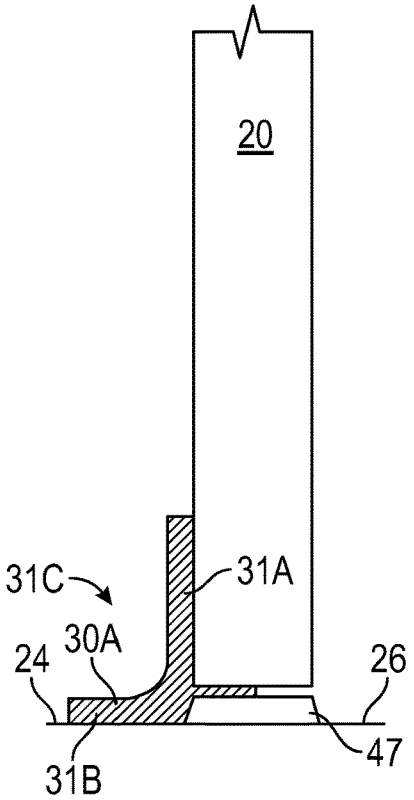
Figure 11:
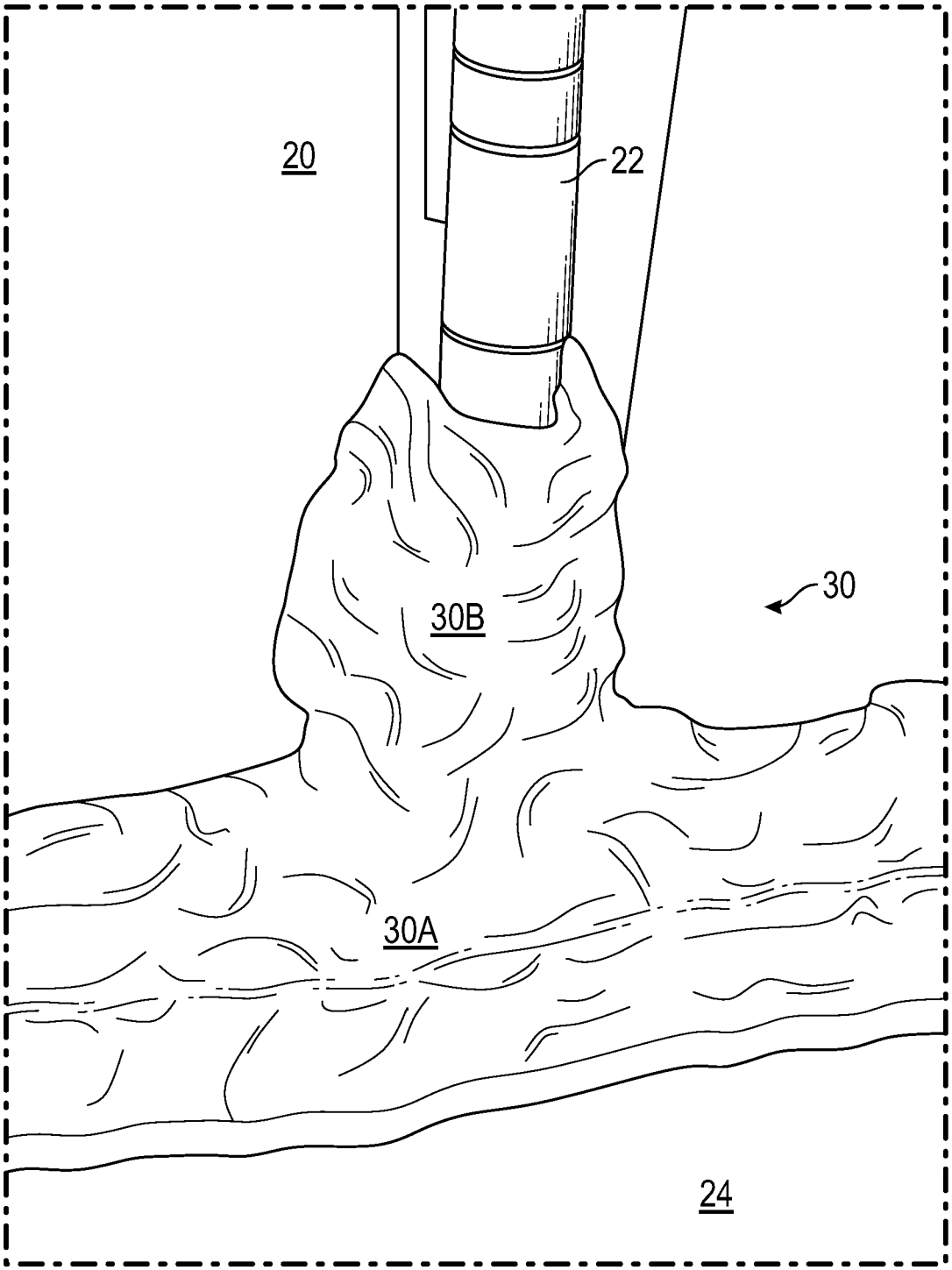

FIGS. 8-11 are enlarged views of portions of the novel seal 30 disclosed herein after the seal 30 has been installed. FIG. 10 is a cross-sectional view taken where indicated in FIG. 9. In the example shown in FIG. 8, one of the vertically oriented portions 30B of the seal 30 seals a portion of the gap 21 between the doors 20. In the example shown in FIG. 9, another one of the vertically oriented portions 30B of the seal 30 effectuates a seal between a portion of the door 20 and a vertical portion (but not all) of the door jamb 25. As shown in FIG. 10, when viewed in a cross-section taken where indicated in FIG. 9, the seal 30 has a substantially L-shaped configuration (that is reversed due to the cross-sectional view) with a substantially vertically oriented leg 31A that engages the interior surface of the door 20 and a substantially horizontally oriented leg 31B that engages the interior floor 24. Due to the nature of human installation and hand molding, there will normally be an irregular curved transition 31C between the substantially vertically oriented leg 31A and the substantially horizontally oriented leg 31B. In one particularly illustrative embodiment, the material with the L-shaped configuration shown in FIG. 10 may be made using a single block 12 of moldable material. Also note that portions of the seal 30, i.e., portions of the moldable material 12, are positioned under the door 20 and above the simplistically depicted door threshold 47. In the example shown in FIG. 11, yet another vertically oriented portion 30B of the seal 30 effectuates the seal between the door 20 and a lowermost hinge 22. In FIGS. 8-11, the substantially horizontally oriented portion 30A of the seal 30 effectuates the seal between the door 20 and the interior floor 24.

Figure 8:
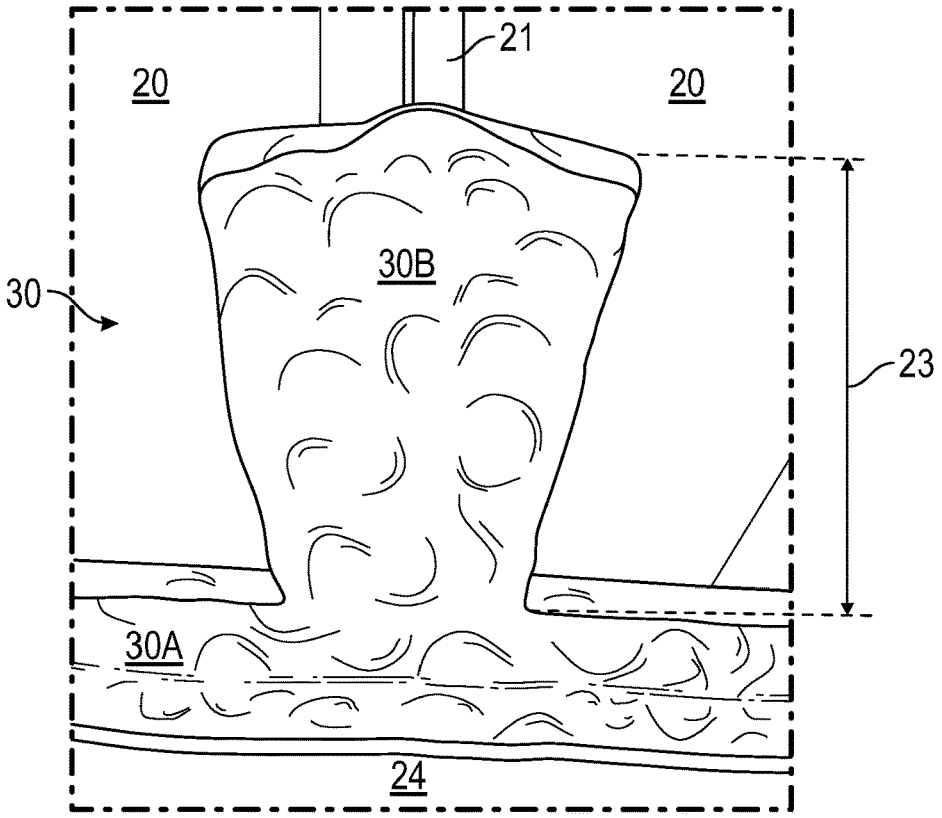
Figure 9:
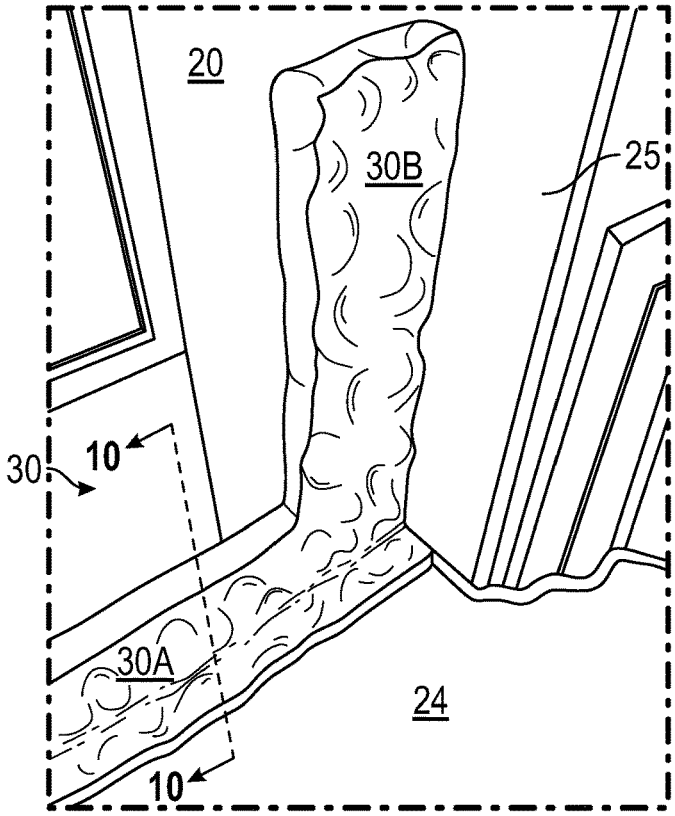
Figure 12:
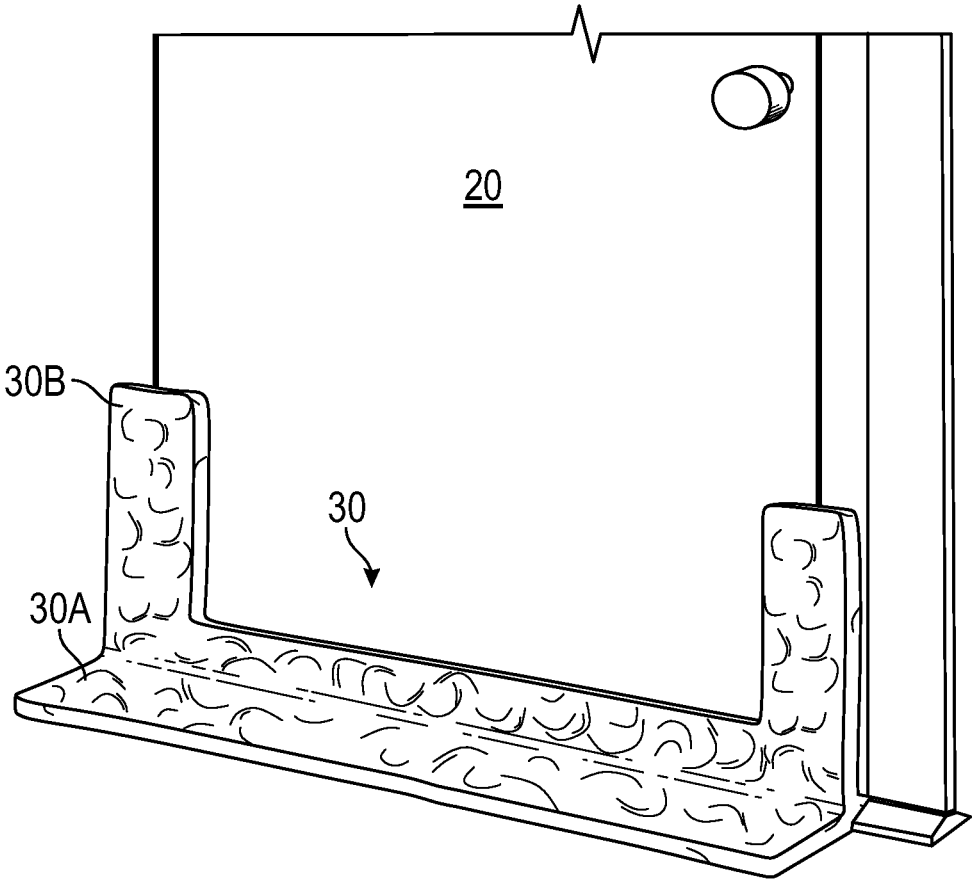

With reference to FIG. 8, the vertical height 23 of the substantially vertically oriented portion(s) 30B of the seal 30 may extend for any desired distance and it may vary depending upon the particular application, e.g., about 10-12 inches (depending upon the initial size of the individual sections 12 of moldable material and/or the desired height of the seal 30 as desired by the homeowner). Moreover, in the case where the seal 30 comprises multiple substantially vertically oriented portions 30B, the height of the substantially vertically oriented portions 30B need not all be the same. In one particular example, the substantially vertically oriented portion(s) 30B may have a height that corresponds approximately to the length 12L of one of the individual sections 12 of moldable material. In other applications, the vertical height 23 may approximately correspond to two or more individual sections 12 of moldable material. However, as will be appreciated by those skilled in the art, in some applications, the novel seal 30 disclosed herein may not include any of the substantially vertically oriented portions 30B. FIG. 12 is a perspective view showing the installation of the seal 30 on a single door 20. As depicted, portions of the moldable material are forced under the bottom of the door 20 and above the door threshold 47 so as to effectuate this portion of the seal 30.

Figure 13:
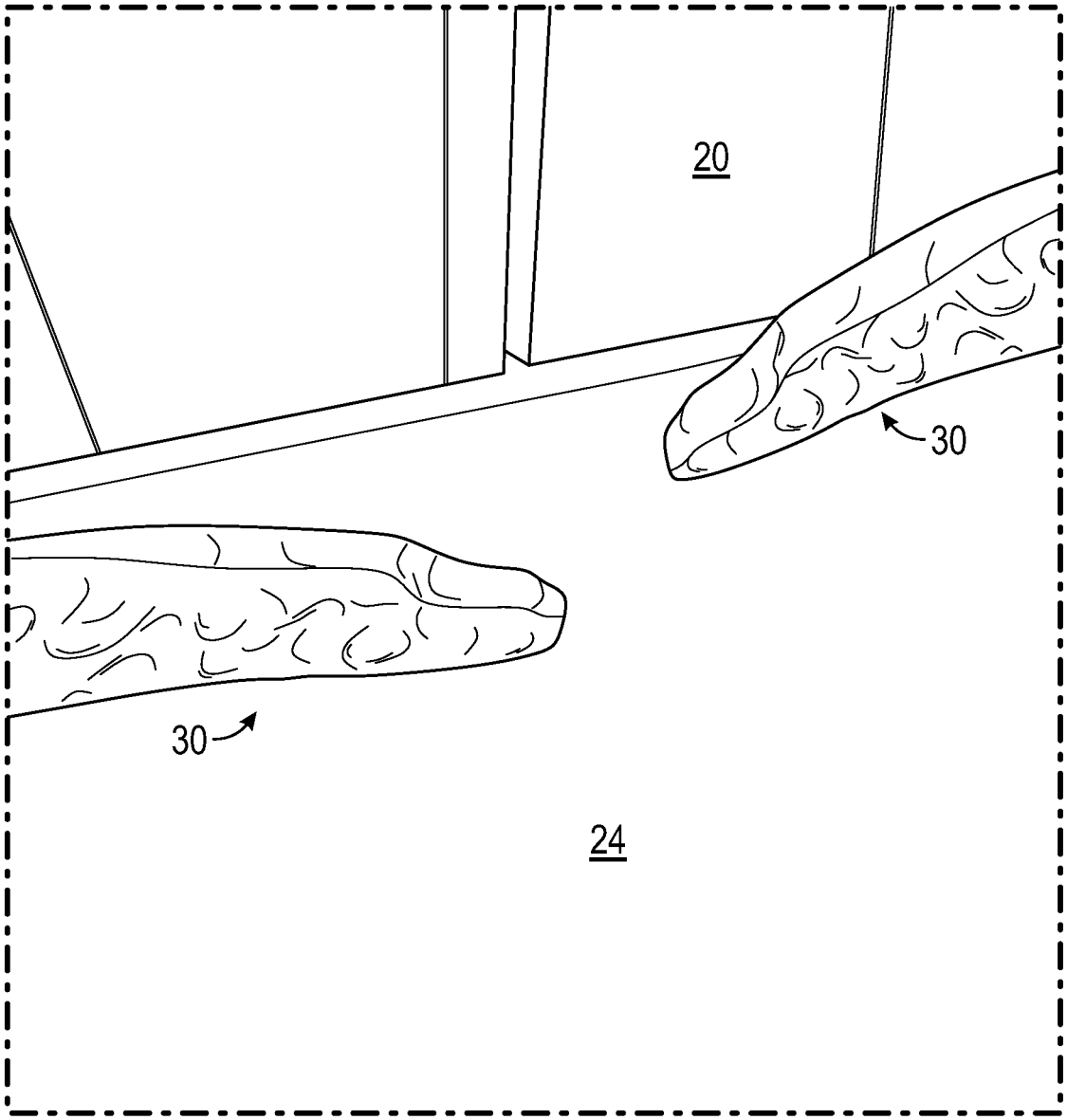

As noted above, the seal disclosed herein is temporary in nature. Once the danger of water entering the building or residence has passed, the novel seal 30 disclosed herein may be readily removed by simply pulling the seal 30 apart by hand, as shown in FIG. 13. Importantly, the moldable material used for the seal 30 described herein is not anticipated to cause any appreciable damage to the surfaces it contacts, such as an interior stained surface of a door or wooden floors within a residence. After the seal 30 is removed, any residual portions of the moldable material may be removed using a damp cloth. In one particular application where the inventor installed such a seal 30 on the interior surface of a stained wooden door, there was no appreciable damage to the stained wooded door when the moldable material was removed after a test was performed to verify the integrity of the seal.

Figure 14:
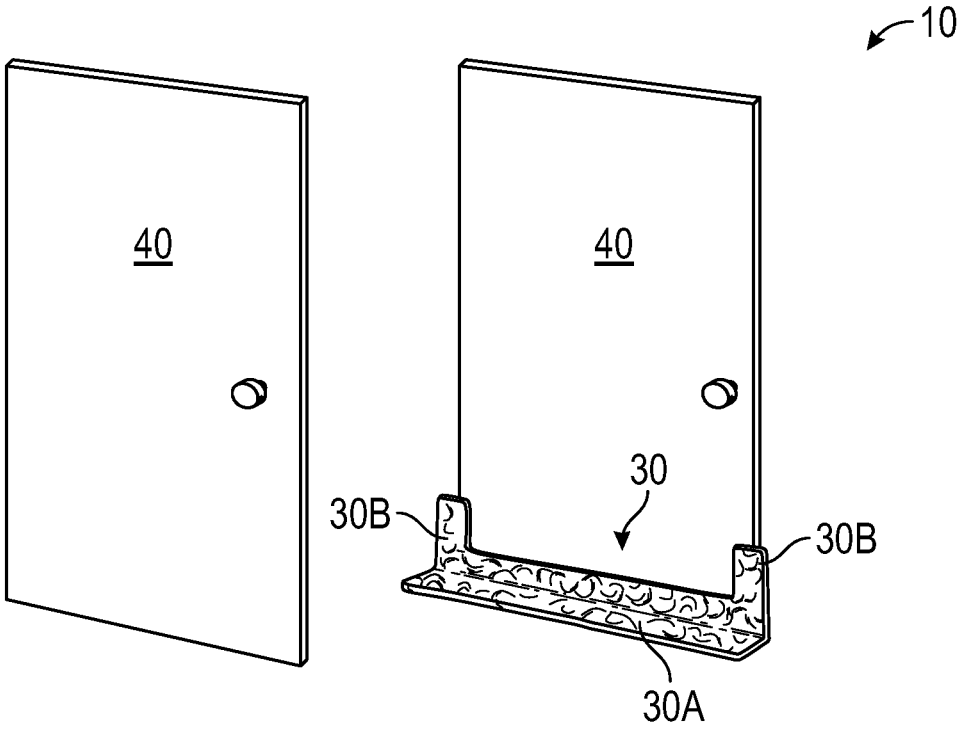
Figure 15:
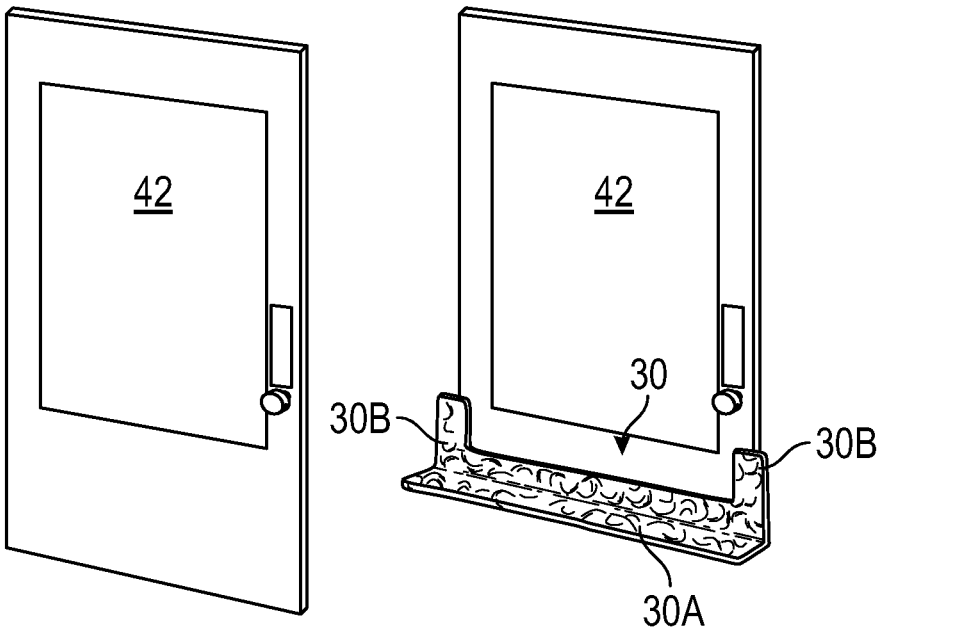
Figure 16:
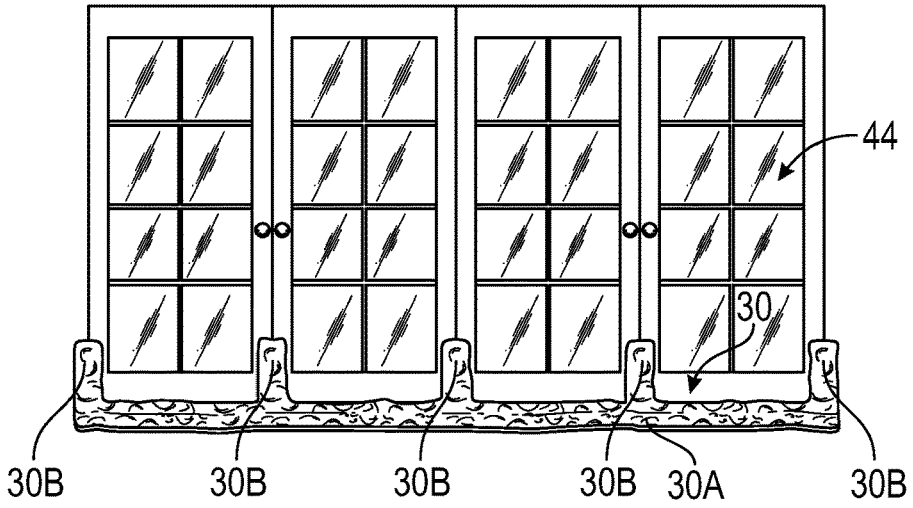
Figure 17:
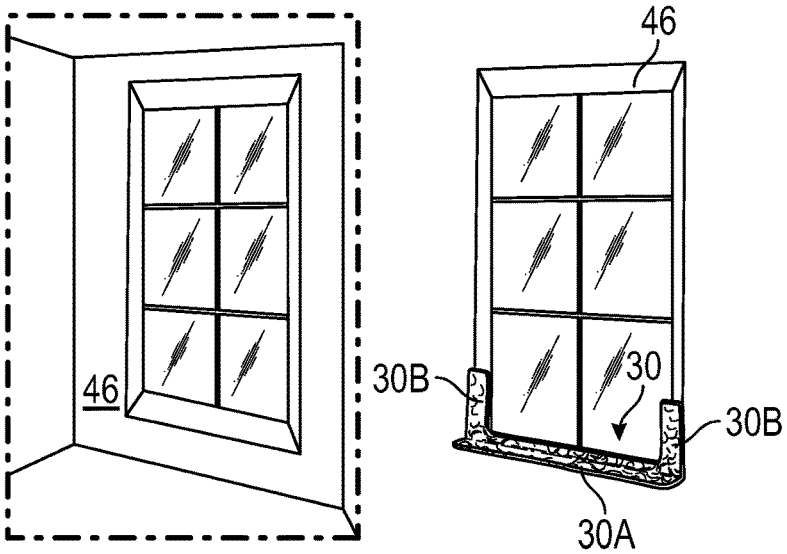
Figure 18:
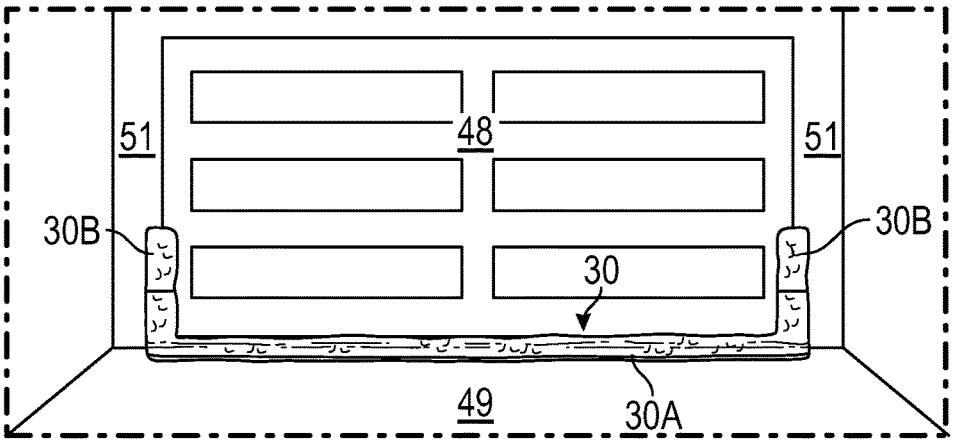

As noted above, the novel seal 30 disclosed herein may be used to form a temporary seal on a variety of different structures. For example, FIG. 14 depicts an example wherein the illustrative U-shaped seal 30 disclosed herein was formed around a traditional single (hollow or solid) wooden or metal door 40. FIG. 15 depicts an example wherein the illustrative U-shaped seal 30 disclosed herein was formed around a typical commercial storefront door 42 with a glass panel. FIG. 16 depicts an example wherein the illustrative U-shaped seal 30 disclosed herein was formed on the interior surfaces of a set of French doors 44. FIG. 17 depicts an example wherein the illustrative U-shaped seal 30 disclosed herein was formed around a typical window 46, wherein the seal 30 engages interior surface portions of the window jamb and the windowsill. FIG. 18 depicts an example wherein the illustrative U-shaped seal 30 disclosed herein was formed around a typical garage door 48, wherein the seal 30 engages portions of the interior surface of the garage door 48, the sidewalls 51 of the garage door opening and the interior garage floor 49. As noted above, if desired, the seal 30 could also be formed on the exterior surface of the garage door 48 wherein it would also engage the driveway.

Figure 19:
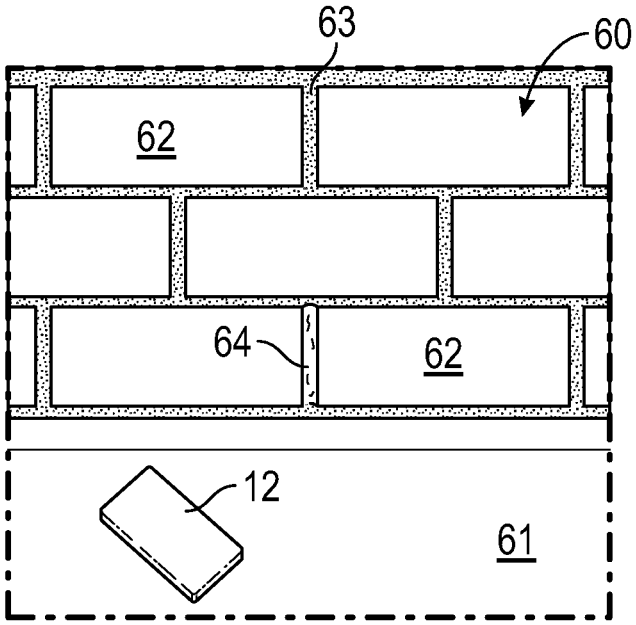
Figure 20:
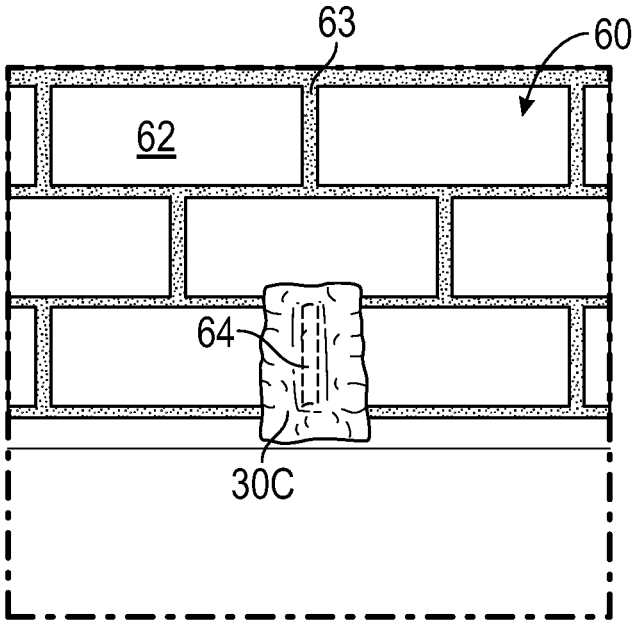
Figure 30:
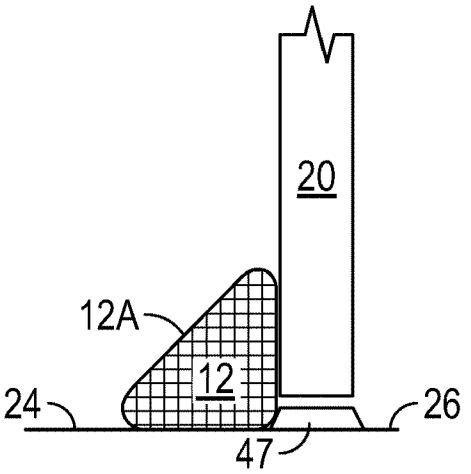
Figure 31:
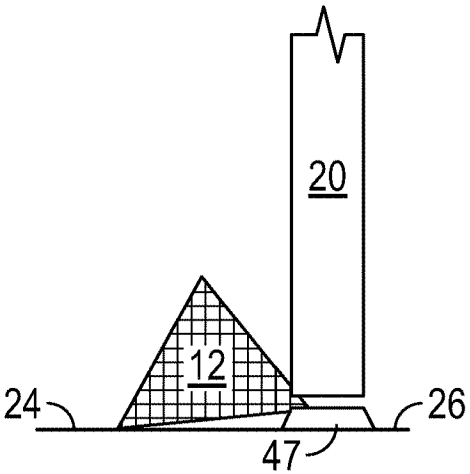
Figure 32:
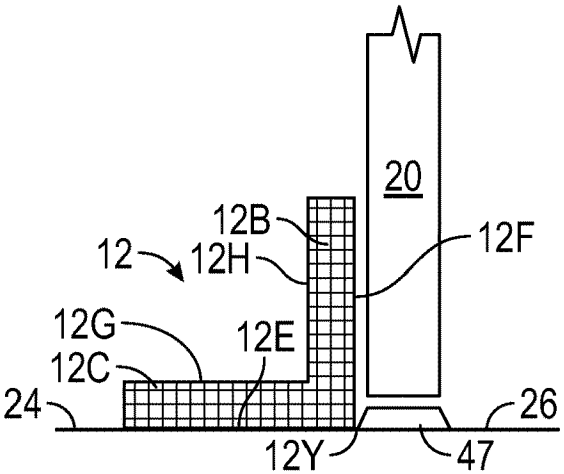
Figure 33:
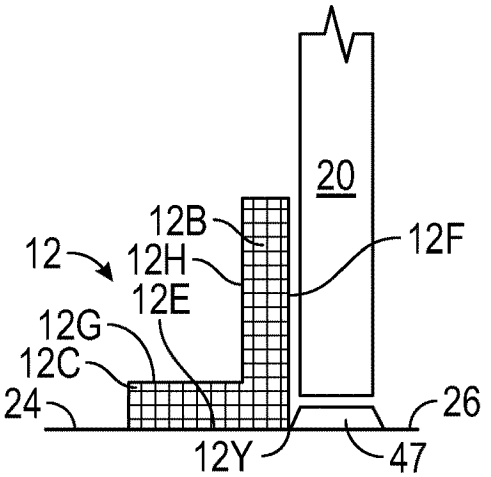
Figure 34:
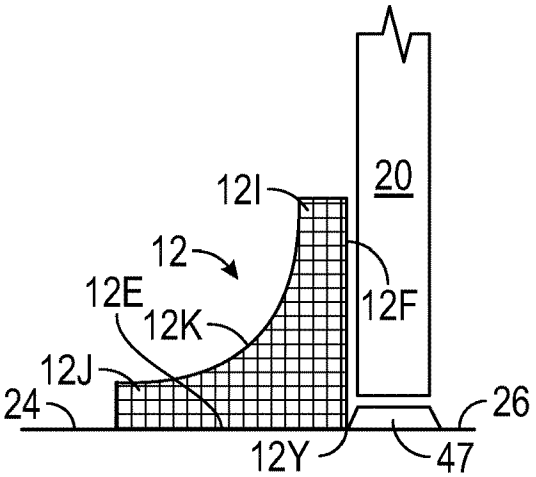
Figure 35:
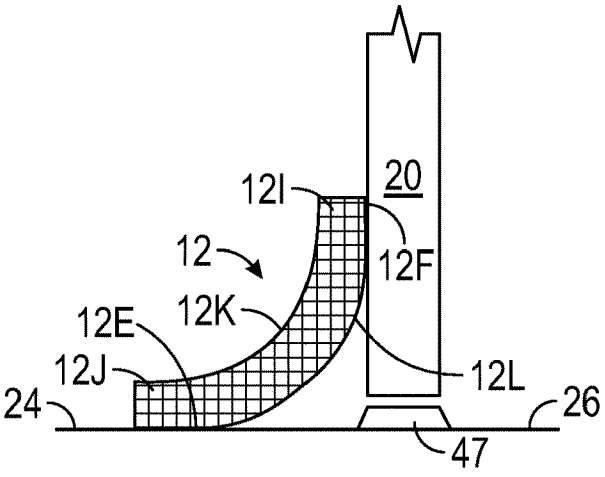

The methods and materials disclosed herein may also be employed to temporarily plug other potential paths or holes for water ingress into a building during flooding conditions. As used herein, the term "building" shall be understood to include any type of structure, such as a commercial building or a residential structure (e.g., single family home, a townhouse, etc.). FIGS. 19-20 illustrate the exterior 60 of a building that is formed on a foundation 61. In this example, the building has a brick exterior comprised of a plurality of bricks 62 with mortar 63 between the bricks 62. As is common practice, such a building may have a plurality of weep holes 64 in the brick wall at a plurality of locations around the perimeter of the building so as to prevent moisture build-up behind the brick wall. Unfortunately, during flooding conditions, such weep holes 64 provide a path for flood water to enter into the building.

However, as shown in FIGS. 19 and 20, using the methods disclosed herein, portions of the sections 12 of moldable material may be used to form a temporary plug 30C in all of the weep holes 64, thereby providing an additional barrier to flood waters entering the building. FIG. 19 depicts the building just prior to plugging the illustrative weep hole, while FIG. 20 depicts the building after a portion of the section 12 of moldable material was forced into the weep hole 64 and between the adjacent bricks 62 on opposite sides of the weep hole 64. As depicted in FIG. 20, portions of the plug 30C engage the exterior surface of the building, i.e., the exterior surfaces of the bricks 62, mortar 63 and foundation 61 so as to effectuate the sealing of the weep holes 64. Of course, the weep hole 64 depicted in FIGS. 19 and 20 is just one example of a potential path for water ingress that may be temporarily sealed using the method disclosed herein. For example, other possible areas that may be temporarily plugged using the methods disclosed herein, include, but are not limited to, plumbing or electrical penetrations of the building that are located at or near ground level, etc. After having benefit of the present disclosure, people of ordinary skill in the art may recognize many other potential applications for the methods and devices disclosed herein. Thus, the presently disclosed inventions should not be considered to be limited to the illustrative examples depicted herein.

The instructions included with the kit 10 may include all or portions of the text above (or equivalent text) describing how to position the sections 12 of moldable material adjacent a structure to be sealed and how to deform the moldable material so as to form the temporary seal 30 and/or plug 30C. The instructions may also include one or more of the drawings in this application, such as FIGS. 5-7 and 19-20, or drawings that depict similar activities as it relates to the formation of the temporary seal 30 and/or plug 30C. In some cases, the kit 10 may contain both text and drawings to instruct an individual as to how to form the temporary seal 30 and/or plug 30C disclosed herein.

FIGS. 21-41 depict other illustrative embodiments of the sections 12 of moldable material disclosed herein. FIG. 21 is a side view of an illustrative section 12 of moldable material having an axial length 12L. Also depicted in FIG. 21 is the location where various cross-sectional views (X-X) of the section 12 of moldable material depicted in subsequent drawings is taken. In general, in the following embodiments, as originally supplied to the customer and prior to deformation of the moldable material (as described above) the sections 12 of moldable material have a substantially non-rectangular cross-sectional configuration for at least a portion of the axial length 12L of the sections 12 of moldable material. In one particular embodiment, the sections 12 of moldable material may have a substantially non-rectangular cross-sectional configuration for substantially the entire axial length 12L of the section 12 of moldable material. Of course, the physical size of the section 12 of moldable material, e.g., the axial length 12, the thickness, etc., may vary depending upon the particular application.

FIGS. 22 and 23 depict an embodiment wherein the sections 12 of moldable material have a three-sided, wedge-shaped cross-sectional configuration, e.g., a substantially triangular-shaped cross-sectional configuration, having sides 12A and an apex 12X. FIG. 22 depicts an embodiment wherein the cross-sectional configuration of the sections 12 of moldable material is that of a substantially right triangle, where the two sides 12A meet at an angle of approximately ninety degrees. FIG. 23 depicts an embodiment wherein the cross-sectional configuration of the sections 12 of moldable material is that of a substantially isosceles triangle (two congruent sides and two congruent angles). The sections 12 of moldable material may also have other triangle-like cross-sectional configurations, e.g., a substantially equilateral triangle (three congruent sides and three congruent angles), a substantially scalene triangle (three sides of unequal length), etc. In short, in one embodiment, the cross-sectional configuration of the sections 12 of moldable material may be an approximation of any type or form of a three-sided wedge-shaped structure or triangle.

Of course, the use of terminology like "substantially triangular-shaped" or the like to describe the cross-sectional configuration of the section 12 of moldable material does not imply geometric precision, as any real-world section 12 of moldable material may not correspond to the shape of a triangle in a geometry class—some variance from the shape of a geometrically pure triangle is to be expected in the case of real-world sections 12 of moldable material. For example, FIG. 29 is a depiction of another embodiment of a section 12 of moldable material having a cross-sectional configuration of a substantially right triangle with a plurality of rounded corners 12R. The degree of rounding may vary depending upon the particular application. Additionally, such rounding may be intentional, or it may be the result of the way the sections 12 of moldable material are manufactured and/or packaged. Of course, some manufacturing techniques may be employed such that the substantially triangular-shaped cross-sectional configuration of the section 12 of moldable material very closely approximates or is the same as that of a geometrically pure triangle. Thus, the use of terminology like "substantially triangular-shaped" or the like should be understood to cover all such embodiments described in this paragraph.

FIGS. 24 and 25 depict an embodiment wherein the sections 12 of moldable material have a substantially L-shaped cross-sectional configuration with a first leg 12B, a second leg 12C, substantially planar out surfaces 12F, 12E that meet at a corner 12Y and substantially planar inner surfaces 12H, 12G. FIG. 24 depicts an embodiment wherein the first leg 12B and the second leg 12C of the L-shaped cross-sectional configuration of the sections 12 of moldable material are substantially the same length. FIG. 25 depicts an embodiment wherein the first leg 12B of the L-shaped cross-sectional configuration of the sections 12 of moldable material has a greater length than the length of the second leg 12C.

FIG. 26 depicts an embodiment wherein the sections 12 of moldable material have an irregular non-rectangular cross-sectional configuration. In this example, the cross-sectional configuration of the sections 12 of moldable material have a first segment 12I and a second segment 12J, substantially planar outer surfaces 12F, 12E that meet at a corner 12Y and a substantially arcuate (concave) or curved inner surface 12K. In one embodiment, the segments 12I, 12J may extend for approximately the same distance from the corner 12Y. In other embodiments, the lengths of the segments 12I, 12J may be different from one another. The radius of curvature of the arcuate surface 12K may vary depending upon the particular application.

FIG. 27 depicts an embodiment wherein the sections 12 of moldable material have another irregular non-rectangular cross-sectional configuration. The example shown in FIG. 27 is similar to the example shown in FIG. 26 except that the embodiment shown in FIG. 27 has a substantially arcuate (convex) or curved outer surface 12L. As with the embodiment shown in FIG. 26, in this embodiment, the segments 12I, 12J may extend for approximately the same distance from the corner 12Y. In other embodiments, the lengths of the segments 12I, 12J may be different from one another. The radius of curvature of the arcuate surface 12L may vary depending upon the particular application.

FIG. 28 depicts an embodiment wherein the sections 12 of moldable material have another irregular non-rectangular cross-sectional configuration. The example shown in FIG. 28 is similar to the example shown in FIG. 27 except that, in the embodiment shown in FIG. 28, the substantially arcuate (concave) or curved inner surface 12K shown in FIG. 27 has been replaced with a substantially planar surface that is positioned opposite the convex or curved outer surface 12L.

The embodiments of the sections 12 of moldable material shown in FIGS. 21-29 may be positioned and installed in a manner that is substantially the same as that described for the sections 12 of moldable material shown in FIGS. 1-4. Accordingly, FIGS. 30-35 are cross-sectional views of the sections 12 of moldable material shown in FIGS. 22-27, respectfully, positioned adjacent the door 20 and the interior floor 24 prior to the sections 12 of moldable material being deformed as described above to effectuate the above-described seal 30.

Figure 36:
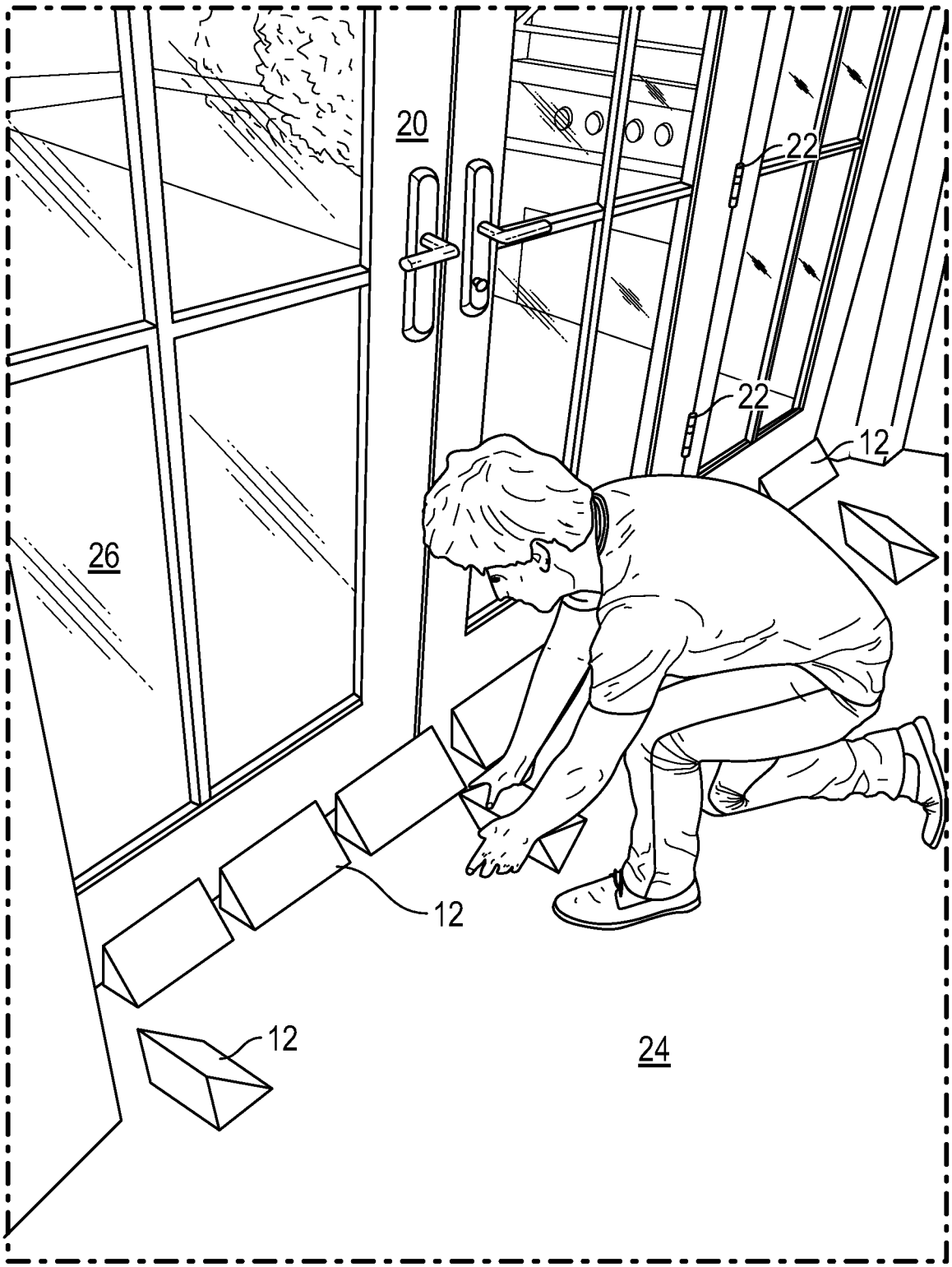

FIG. 36 depicts an embodiment wherein the novel seal 30 disclosed herein will be formed adjacent a structure or door 20, in this case a set of double doors. In this example, the cross-sectional configuration of the sections 12 of moldable material is that of a substantially right triangle, as shown in FIG. 22. At the point shown in FIG. 36, the individual sections 12 of moldable material have been removed from the package 11 and placed in approximate locations adjacent the door 20 on the interior side of the door 20. In the example disclosed herein, the seal 30 will be formed on the interior surface of the door 20. However, as will be appreciated by those skilled in the art after a complete reading of the present application, the novel seal 30 disclosed herein may also be formed on the exterior surface of the door 20 or on both the interior and exterior surfaces of the door 20. With reference to FIG. 36, the door 20 is mounted to a door frame or jamb with a plurality of hinges 22. The interior floor 24 and exterior floor 26 of the building are also depicted in FIG. 36. The novel seal 30 disclosed herein may be employed irrespective of the type of flooring used for the interior and exterior floors 24, 26, e.g., bricks, blocks, wood, tile, etc., and irrespective of the surface finish of the interior and exterior floors 24, 26. That is, one feature of the novel seal 30 disclosed herein is that, due to the moldable nature of the molding material of the sections 12, the material may be deformed to accommodate virtually any type of surface (be it smooth, or rough or irregular) on either the floor, the door jamb, the hinges or the door itself so as to form the desired seal 30.

Figure 37:
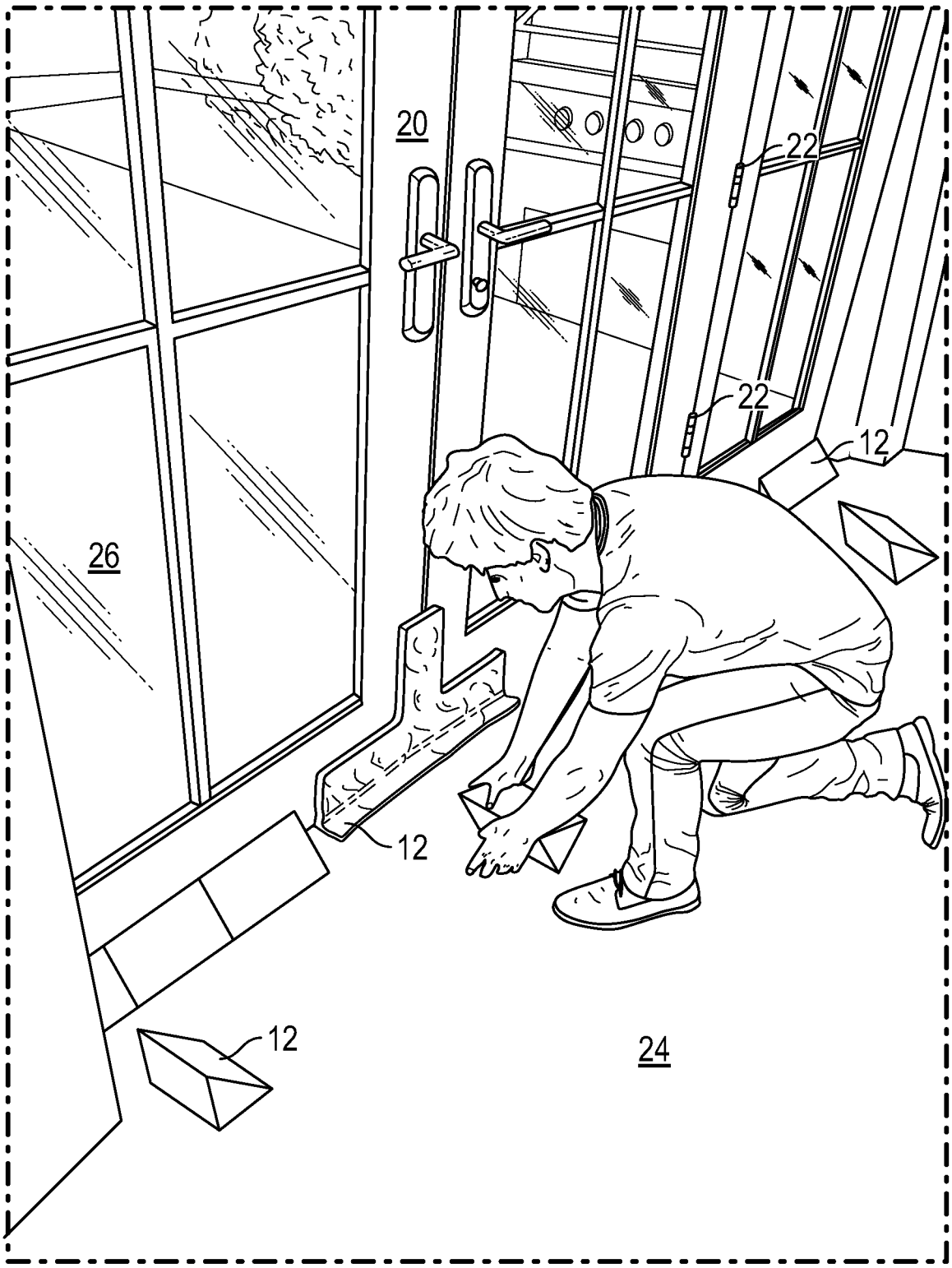

At the point of operations shown in FIG. 37, the individual sections 12 of moldable material have been positioned laterally adjacent one another in preparation of beginning the actual process of forming the seal 30 and some of the individual sections have been deformed by the individual as part of the process of forming the seal 30. Prior to this point, if needed, one or more sections of the individual sections 12 of moldable material may be cut to a shorter desired length to, for example, fill in a gap between the end of a section and the door jamb, wherein the gap is less than the full length of a single section 12. The moldable material used herein may be readily cut with a common case knife, a putty knife, or it may even be torn into smaller sections by hand.

After deformation and installation of the novel seal 30 disclosed herein, the sections 12 of moldable material shown in FIG. 36 may have substantially the same appearance and configuration of the sections 12 of moldable material shown in FIGS. 7-11 above. As with the previous embodiments, the sections 12 of moldable material with a non-rectangular cross-sectional configuration may be used to form a temporary seal on a variety of different structures, e.g., a traditional single (hollow or solid) wooden or metal door, a typical commercial storefront door with a glass panel, a set of French doors, a typical window (wherein the seal 30 engages interior surface portions of the window jamb and the window sill), a typical garage door (wherein the seal 30 engages portions of the interior surface of the garage door, the sidewalls of the garage door opening and the interior garage floor), etc. Additionally, the sections 12 of moldable material with a non-rectangular cross-sectional configuration may be used to form a temporary plug 30C in all of the weep holes of a brick building.

Figure 38:
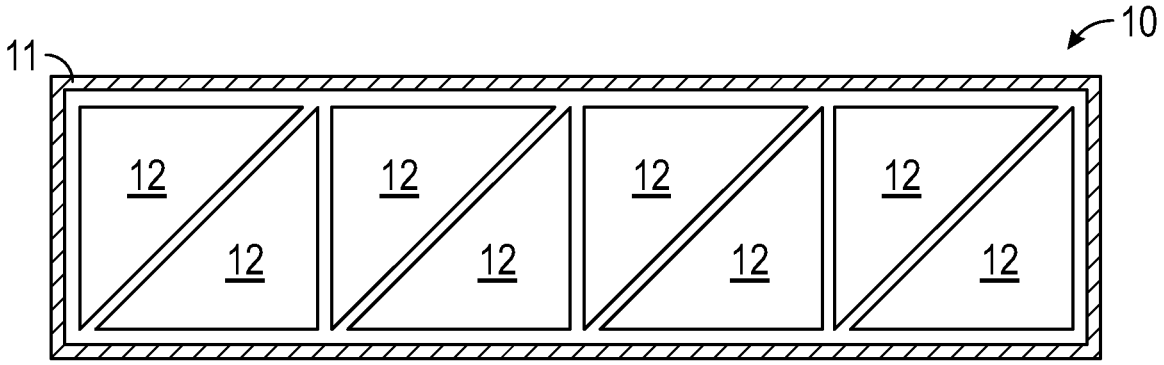
Figure 39:
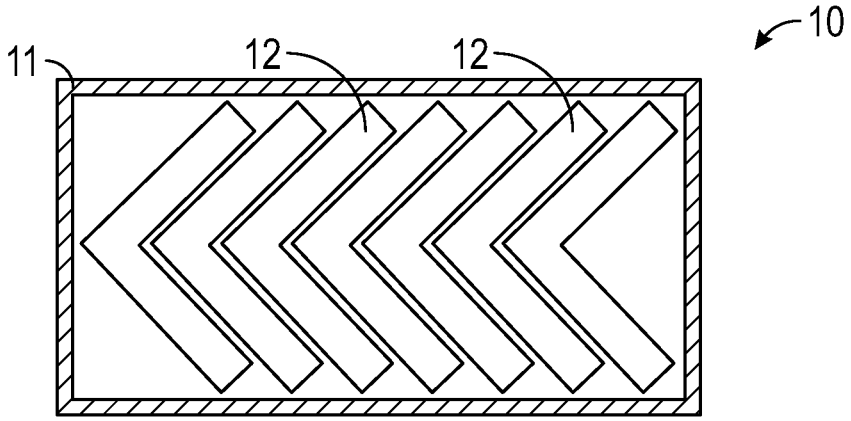
Figure 40:
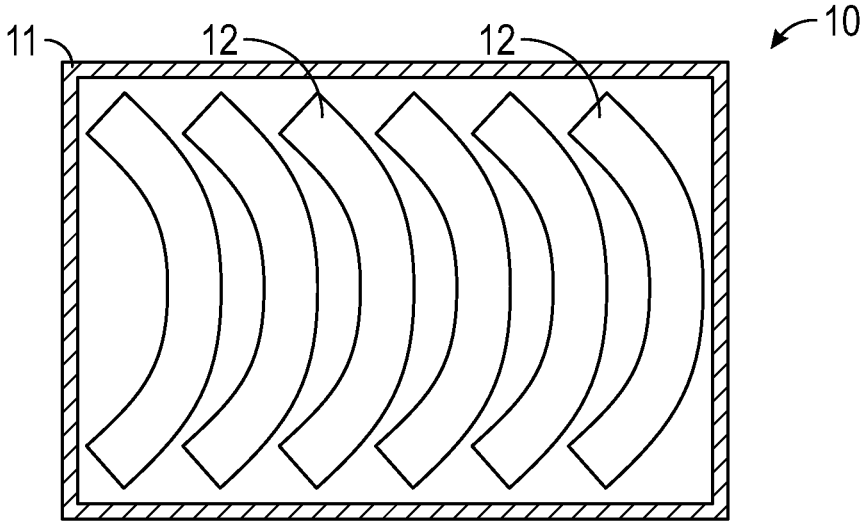

The embodiments of the sections 12 of moldable material shown in FIGS. 21-29 may be packaged and wrapped (collectively and/or individually) in a manner that is substantially the same as that described for the sections 12 of moldable material shown in FIGS. 1-4. FIGS. 38-40 are plan views of various illustrative embodiments of a kit 10 that includes a package 11 or box that contains a plurality of individual sections 12 of hand-moldable material that have a substantially non-rectangular cross-sectional configuration for at least a portion of the axial length 12L of the sections 12 of moldable material, as described above with reference to FIGS. 22-29. FIG. 38 depicts an embodiment wherein eight illustrative sections 12 of moldable material having the cross-sectional configuration depicted in FIG. 22 are positioned in the package 11. FIG. 39 depicts an embodiment wherein seven illustrative sections 12 of moldable material having the cross-sectional configuration depicted in FIG. 24 are positioned in the package 11. FIG. 40 depicts an embodiment wherein six illustrative sections 12 of moldable material having the cross-sectional configuration depicted in FIG. 27 are positioned in the package 11. Of course, the package 11 may contain any number of the sections 12 of moldable material, and they need not all have the same cross-sectional configuration, but that may be the case in some applications. In other applications, the package 11 may contain one or more of the sections 12 of moldable material that have a substantially non-rectangular cross-sectional configuration as well as one or more sections 12 of moldable material shown in FIGS. 1-4, sections 12 of moldable material that have a substantially rectangular cross-sectional configuration.

FIG. 41 depicts an embodiment of a door hanger 70 that may be included with the kit 10. The door hanger 70 may include instructions directing consumers as to how to install the various embodiment of the sections 12 of moldable material described above that may be positioned on the door as the consumer actually installs the sections 12 of moldable material. The door hanger 70 may also include a reminder to the consumer to remove the deformed sections 12 of moldable material as soon as the danger of water ingress has passed.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

What is claimed is:

1. A device, comprising:

a package; and a plurality of individual sections of a non-hardening moldable material positioned within the package, each of the individual sections of the moldable material having an axial length and a lateral width that is transverse to the axial length, the axial length being greater than said lateral width, wherein, when viewed in a cross-section taken through the individual sections of non-hardening moldable material in a direction transverse to the axial length, each of the individual sections of the non-hardening moldable material have a non-rectangular cross-sectional configuration for at least a portion of the axial length of each of the individual sections of the non-hardening moldable material and wherein the individual sections of the non-hardening moldable material are positioned adjacent one another and adjacent a first structure to be sealed, the first structure being operatively coupled to a second structure comprising an opening wherein the first structure to be sealed is adapted to be moved from an open position to a closed position, and vice versa, relative to the opening in the second structure, such that, when the first structure to be sealed is moved to the closed position relative to the opening in the second structure, the individual sections of the non-hardening moldable material are deformed to form a substantially contiguous temporary seal against water encroachment between the first structure and at least a portion of the opening in the second structure, where the individual sections of the non-hardening moldable material forming the substantially contiguous temporary seal against water encroachment are further removed from the first structure and at least a portion of the opening in the second structure.

2. The device of claim 1, wherein each of the individual sections of the non-hardening moldable material have the non-rectangular cross-sectional configuration for substantially the entire axial length of each of the individual sections of the non-hardening moldable material.

3. The device of claim 1, wherein the non-rectangular cross-sectional configuration comprises one of a substantially triangular-shaped configuration or a substantially L-shaped cross-sectional configuration.

4. The device of claim 1, wherein all of the plurality of individual sections of the non-hardening moldable material have substantially the same cross-sectional configuration.

5. The device of claim 1, further comprising at least one additional individual section of a non-hardening moldable material positioned within the package, wherein the at least one additional individual section of the non-hardening moldable material has a substantially rectangular cross-sectional configuration.

6. The device of claim 1, wherein each of the plurality of individual sections of the non-hardening moldable material are separated from one another by at least one layer of material.

7. The device of claim 1, wherein each of the plurality of individual sections of the non-hardening moldable material are individually wrapped in a wrapping material.

8. The device of claim 1, wherein the package comprises one of a box or a shrink-wrapped material.

9. The device of claim 1, wherein the first structure comprises a door and the second structure comprises a door jamb positioned above a floor, wherein the opening is at least partially defined by the door jamb and the floor, wherein the plurality of individual sections of the non-hardening moldable material are forced against at least the door, the floor and the door jamb.

10. The device of claim 9, wherein the door is coupled to the door jamb by at least one hinge, and wherein at least one of the plurality of individual sections of the non-hardening moldable material is forced against at least the door and the at least one hinge.

11. The device of claim 1, wherein the first structure comprises a window and the second structure comprises a window sill, wherein the opening is at least partially defined by the window sill, wherein the plurality of individual sections of the non-hardening moldable material are forced against at least the window and the window sill.

12. The device of claim 1, wherein the plurality of individual sections of the non-hardening moldable material are positioned adjacent at least one of an interior surface or an exterior surface of the first structure.

13. The device of claim 1, wherein the plurality of individual sections of the non-hardening moldable material are deformed into the temporary substantially contiguous seal by manually applying force to the plurality of individual sections of the non-hardening moldable material.

14. The device of claim 1, wherein the plurality of individual sections of non-hardening moldable material have a thickness that permits the plurality of individual sections of the non-hardening moldable material to be deformed into the temporary substantially contiguous seal by application of a manual force.

15. The device of claim 1, wherein the number of the plurality of individual sections of the non-hardening moldable material is sufficient to permit the formation of the temporary substantially contiguous seal on a standard door having a width of about 36 inches.

16. The device of claim 1, wherein all of the plurality of individual sections of the non-hardening moldable material are all the same physical size.

17. The device of claim 1, wherein the temporary substantially contiguous seal is positioned adjacent a bottom and a vertical portion of opposing side surfaces of the first structure.

18. The device of claim 1, wherein the non-rectangular cross-sectional configuration is partially defined by a substantially arcuate surface.

19. The device of claim 1, further comprising a door hanger positioned within the package, the door hanger having instructions thereon for how to deform the individual sections of a non-hardening moldable material into the temporary substantially contiguous seal between a first structure and a second structure, wherein the second structure comprises an opening.

20. A device, comprising:

a package; and a plurality of individual sections of a non-hardening moldable material positioned within the package, each of the individual sections of the moldable material having an axial length and a lateral width that is transverse to the axial length, the axial length being greater than the lateral width, wherein, when viewed in a cross-section taken through the individual sections of non-hardening moldable material in a direction transverse to the axial length, each of the individual sections of the non-hardening moldable material have a non rectangular cross-sectional configuration for substantially the entire axial length of each of the individual sections of the non-hardening moldable material and wherein the individual sections of the moldable material are positioned adjacent one another and adjacent a first structure to be sealed, the first structure being operatively coupled to a second structure comprising an opening wherein the first structure to be sealed is adapted to be moved from an open position to a closed position, and vice versa, relative to the opening in the second structure, such that, when the first structure to be sealed is moved to the closed position relative to the opening in the second structure, the individual sections of the non-hardening moldable material are deformed to form a substantially contiguous temporary seal against water encroachment between the first structure and at least a portion of the opening in the second structure, where the individual sections of the non-hardening moldable material forming the substantially contiguous temporary seal against water encroachment are further removed from the first structure and at least a portion of the opening in the second structure.

21. The device of claim 20, further comprising a door hanger positioned within the package, the door hanger having instructions thereon for how to deform the individual sections of a non-hardening moldable material into the temporary substantially contiguous seal between the first structure and the second structure.

22. A device, comprising:

a package; and a plurality of individual sections of a non-hardening moldable material positioned within the package, each of the individual sections of the non-hardening moldable material having an axial length and a lateral width that is transverse to the axial length, the axial length being greater than the lateral width, wherein, when viewed in a cross-section taken through the individual sections of non-hardening moldable material in a direction transverse to the axial length, each of the individual sections of the non-hardening moldable material have a substantially triangular-shaped cross-sectional configuration for substantially the entire axial length of each of the individual sections of the non-hardening moldable material and wherein the individual sections of the non-hardening moldable material are positioned adjacent one another and adjacent a first structure to be sealed, the first structure being operatively coupled to a second structure comprising an opening wherein the first structure to be sealed is adapted to be moved from an open position to a closed position, and vice versa, relative to the opening in the second structure, such that, when the first structure to be sealed is moved to the closed position relative to the opening in the second structure, the individual sections of the non-hardening moldable material are deformed to form a substantially contiguous temporary seal against water encroachment between the first structure and at least a portion of the opening in the second structure, where the individual sections of the non-hardening moldable material forming the substantially contiguous temporary seal against water encroachment are further removed from the first structure and at least a portion of the opening in the second structure.

23. The device of claim 22, further comprising a door hanger positioned within the package, the door hanger having instructions thereon for how to deform the non-hardening individual sections of a moldable material into a temporary substantially contiguous seal between the first structure and the second structure.

24. A device, comprising:

a package; and a plurality of individual sections of a non-hardening moldable material positioned within the package, each of the individual sections of the non-hardening moldable material having an axial length and a lateral width that is transverse to the axial length, the axial length being greater than the lateral width, wherein, when viewed in a cross-section taken through the individual sections of non-hardening moldable material in a direction transverse to the axial length, each of the individual sections of the non-hardening moldable material have a substantially L-shaped cross-sectional configuration for substantially the entire axial length of each of the individual sections of the non-hardening moldable material and wherein the individual sections of the moldable material are positioned adjacent one another and adjacent a first structure to be sealed, the first structure being operatively coupled to a second structure comprising an opening wherein the first structure to be sealed is adapted to be moved from an open position to a closed position, and vice versa, relative to the opening in the second structure, such that, when the first structure to be sealed is moved to the closed position relative to the opening in the second structure, the individual sections of the non-hardening moldable material are deformed to form a substantially contiguous temporary seal against water encroachment between the first structure and at least a portion of the opening in the second structure, where the individual sections of the non-hardening moldable material forming the substantially contiguous temporary seal against water encroachment are further removed from the first structure and at least a portion of the opening in the second structure.

25. The device of claim 24, wherein each of the individual sections of the moldable material are adapted to be deformed into a temporary substantially contiguous seal between a first structure and a second structure, wherein the second structure comprises an opening and wherein the first structure is adapted to be moved from an open position to a closed position relative to the opening in the second structure, and vice versa.

* * * * *